US011478688B2

(12) United States Patent
Zoretic

(10) Patent No.: US 11,478,688 B2
(45) **Date of Patent: *Oct. 25, 2022**

(54) GOAL SHOOTING TARGET

(71) Applicant: Krusader LLC, Ladera Ranch, CA (US)

(72) Inventor: Marko Romeo Zoretic, Coto de Caza, CA (US)

(73) Assignee: Krusader LLC, Ladera Ranch, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/876,602

(22) Filed: May 18, 2020

(65) Prior Publication Data

US 2021/0001195 A1 Jan. 7, 2021

Related U.S. Application Data

(63) Continuation of application No. 15/950,375, filed on Apr. 11, 2018, now Pat. No. 10,668,346.

(60) Provisional application No. 62/484,286, filed on Apr. 11, 2017.

(51) Int. Cl.

| | |
|---|---|
| ***A63B 69/00*** | (2006.01) |
| ***A63B 63/00*** | (2006.01) |
| *A63B 102/14* | (2015.01) |
| *A63B 102/24* | (2015.01) |

(52) U.S. Cl.

CPC ..... *A63B 69/0026* (2013.01); *A63B 63/004* (2013.01); *A63B 69/002* (2013.01); *A63B 2102/14* (2015.10); *A63B 2102/24* (2015.10); *A63B 2209/10* (2013.01); *A63B 2210/50* (2013.01); *A63B 2225/09* (2013.01); *A63B 2243/0025* (2013.01)

(58) Field of Classification Search

CPC . A63B 69/0026; A63B 69/002; A63B 63/004; A63B 2102/14; A63B 2102/24; A63B 2210/50; A63B 2225/09; A63B 2243/0025

USPC ..... 473/446, 422, 197, 438, 434, 435, 421, 473/454, 455, 456

See application file for complete search history.

(56) References Cited

U.S. PATENT DOCUMENTS

| | | | | | |
|---|---|---|---|---|---|
| 4,083,561 | A * | 4/1978 | Daffer, Jr. | A63B 63/004 | 473/432 |
| 4,210,326 | A * | 7/1980 | Booth | A63B 63/00 | 473/454 |
| 4,407,507 | A * | 10/1983 | Caruso | A63B 63/004 | 273/400 |

(Continued)

FOREIGN PATENT DOCUMENTS

| | | |
|---|---|---|
| FR | 2779356 A1 | 12/1999 |
| GB | 2293327 A | 3/1996 |
| GB | 2483067 A | 2/2012 |

*Primary Examiner* — Mitra Aryanpour

(74) *Attorney, Agent, or Firm* — Perkins Coie LLP

(57) ABSTRACT

A goal shooting target can be used to develop skills in many sports. The goal shooting target can include a panel that deflects objects when the panel is placed at a face or opening of a sports goal. The panel and sports goal can define target openings through which objects are capable of passing. The panel can be configured to carry a frame of the sports goal such that posts of the sports goal are held off of a support surface upon which the goal shooting target rests.

6 Claims, 19 Drawing Sheets

(56) References Cited

U.S. PATENT DOCUMENTS 4,921,257 A * 5/1990 Heller ..... A63B 63/00 473/446
4,948,147 A * 8/1990 Pallanca ..... A63B 63/00 473/478
5,080,375 A * 1/1992 Moosavi ..... A63B 63/004 473/478
5,181,725 A * 1/1993 Leras ..... A63B 63/004 473/446
5,308,083 A * 5/1994 Grunfeld ..... A63B 63/004 273/396
5,367,503 A * 11/1994 Lowrance ..... F41J 7/04 273/375
5,503,402 A * 4/1996 Moss, Jr. ..... A63B 63/004 473/446
5,513,843 A * 5/1996 Russell ..... A63B 63/004 473/419
5,725,444 A * 3/1998 Heden ..... A63B 63/00 473/446
5,820,497 A * 10/1998 Pena ..... A63B 63/004 473/471
5,951,415 A * 9/1999 Gates ..... A63B 63/004 473/478
6,287,220 B1 * 9/2001 Caruso ..... A63B 63/00 473/415
6,508,729 B1 * 1/2003 Coltrane ..... A63B 63/00 473/446
6,695,724 B2 * 2/2004 Birss ..... A63B 63/004 473/446
6,846,253 B1 * 1/2005 Szwalek ..... A63B 69/0097 473/446
6,860,825 B2 * 3/2005 Clark ..... A63B 63/00 473/478
7,037,219 B2 * 5/2006 Pakieser ..... A63B 69/002 473/422
7,134,976 B1 * 11/2006 Smith ..... A63B 24/0021 473/446
7,614,968 B1 * 11/2009 Davies ..... A63B 24/0021 473/466
7,651,416 B2 * 1/2010 Farquhar ..... A63B 63/004 473/446
8,376,852 B2 * 2/2013 Kao ..... A63F 9/24 473/446
8,961,339 B2 * 2/2015 Littman ..... A63B 63/00 473/422
9,724,580 B2 * 8/2017 Goldwitz ..... A63B 69/00 473/446
10,668,346 B2 * 6/2020 Zoretic ..... A63B 69/0026 473/446
2004/0072635 A1 4/2004 Clark
2005/0062231 A1 * 3/2005 Oister ..... A63B 63/004 473/477
2007/0235942 A1 * 10/2007 Cho ..... A63B 63/004 273/395
2008/0032826 A1 * 2/2008 Mubarak ..... A63B 67/002 473/446
2011/0015002 A1 * 1/2011 Brown ..... A63B 63/00 473/446
2013/0303312 A1 * 11/2013 DeBolt ..... A63B 69/00 473/446
2014/0171225 A1 * 6/2014 Paulson ..... A63B 71/022 473/421

* cited by examiner

GOAL SHOOTING TARGET

CROSS-REFERENCE TO RELATED APPLICATIONS

This application is a continuation of U.S. patent application Ser. No. 15/950,375 filed on Apr. 11, 2018 (now U.S. Pat. No. 10,668,346), entitled "GOAL SHOOTING TARGET," which claims the benefit of and priority to U.S. Provisional Patent Application No. 62/484,286 filed on Apr. 11, 2017, entitled "GOAL SHOOTING TARGET," which are incorporated herein by reference in their entireties.

TECHNICAL FIELD

The present invention relates generally to sport-training devices and more specifically to goal shooting targets that can be placed at the face or opening of a sports goal. The sports goal can be a hockey goal, soccer goal, lacrosse goal, or other suitable goal that define areas for players to target playing objects.

BACKGROUND

Shooting a playing object is an essential skill in many sports, such as in hockey, soccer, and lacrosse. Practicing shooting is typically done with players shooting on a goalie. A player or coach may desire that a player practice shooting on his or her own because a goalie may not be available. Thus, there is a need for a device that allows a player to practice shooting skills on his or her own.

SUMMARY OF TECHNOLOGY

In some embodiments a goal shooting target includes a panel, at least one sport goal support, and rigid engagement members. The panel can be configured to deflect playing objects shot at a sports goal. The sports goal support can be coupled to the panel and can be configured to carry at least a portion of a frame of the sports goal such that posts of the frame of the sports goal are held off of a support surface upon which the goal shooting target rests. The rigid engagement members are configured to engage the frame of the sports goal to keep the panel at an opening of the sports goal when the panel is struck by objects. The panel and the sports goal define at least one target opening through which the object is capable of passing to practice shooting. Different panels can be installed in the sports goal to practice a variety of shooting skills.

The rigid engagement members can include crossbar seats, post holders, or combinations thereof. Each goal support can include, for example, a first sports goal support insertable into a first post of the sports goal and a second sports goal support insertable into a second post of the sports goal. Most of the weight of the sports goal is supported by the goal shooting target. The crossbar seat can be a rigid arcuate member configured to receive and extend along opposite sides of the crossbar while the goal shooting target holds the sports goal at a raised position. In some embodiments, the arcuate member is configured to circumferentially surround the crossbar.

In some embodiments, a goal shooting target includes a panel configured to block objects (e.g., objects shot anywhere at the panel), at least one crossbar seat, and at least one foot. The crossbar seat is coupled to the panel and configured to carry a crossbar of the goal such that the panel and the sports goal define one or more target openings for practicing shooting. Each foot can be coupled to the panel and configured to rest on a support surface to keep the panel at an upright position. The goal shooting target can hold posts of the sports goal off of the support surface.

The crossbar seat can be positioned to hold the crossbar such that the sports goal captively holds the goal shooting target on the support surface. In some embodiments, the panel obstructs most of an area of an opening of the sports goal. The panel can include a frame and an object blocking material (e.g., netting) and can be shaped to correspond to an area typically covered by a goalie.

In further embodiments, a goal target includes a first member, a second member, and a panel. The first member is configured to be inserted into a first post of a sports goal. The second member is configured to be inserted into a second post of the sports goal. The panel is coupled to the first and second members. The goal target can hold the sports goal substantially stationary during use.

In some embodiments, a system includes a goal shooting target and a shot blocker. The goal shooting target can engage a sports goal and can include a goal shooting target having a panel configured to deflect an object shot at the panel. The shot blocker can be removably coupled to the panel and the sports goal such that the blocker extends across and at least partially blocks an opening. While the panel is coupled to the sports goal, the shot blocker can be installed at different locations to at least partially block different openings through which an object (e.g., a hockey puck) could otherwise pass. In certain embodiments, the blocker includes a first end removably coupleable to the panel and a second end removably coupleable to the sports goal. The blocker and/or goal shooting target are configured to deflect a hockey puck, or other objects, traveling at a speed equal to or greater than about 65 mph, about 70 mph, about 80 mph, about 90 mph, about 100 mph, or other speeds without being permanently damaged.

BRIEF DESCRIPTION OF THE DRAWINGS

Aspects and advantages are described below with reference to drawings of various embodiments, which are intended to illustrate, but not to limit the present technology. Identical reference numbers identify similar elements or acts.

DETAILED DESCRIPTION

Figure 1:
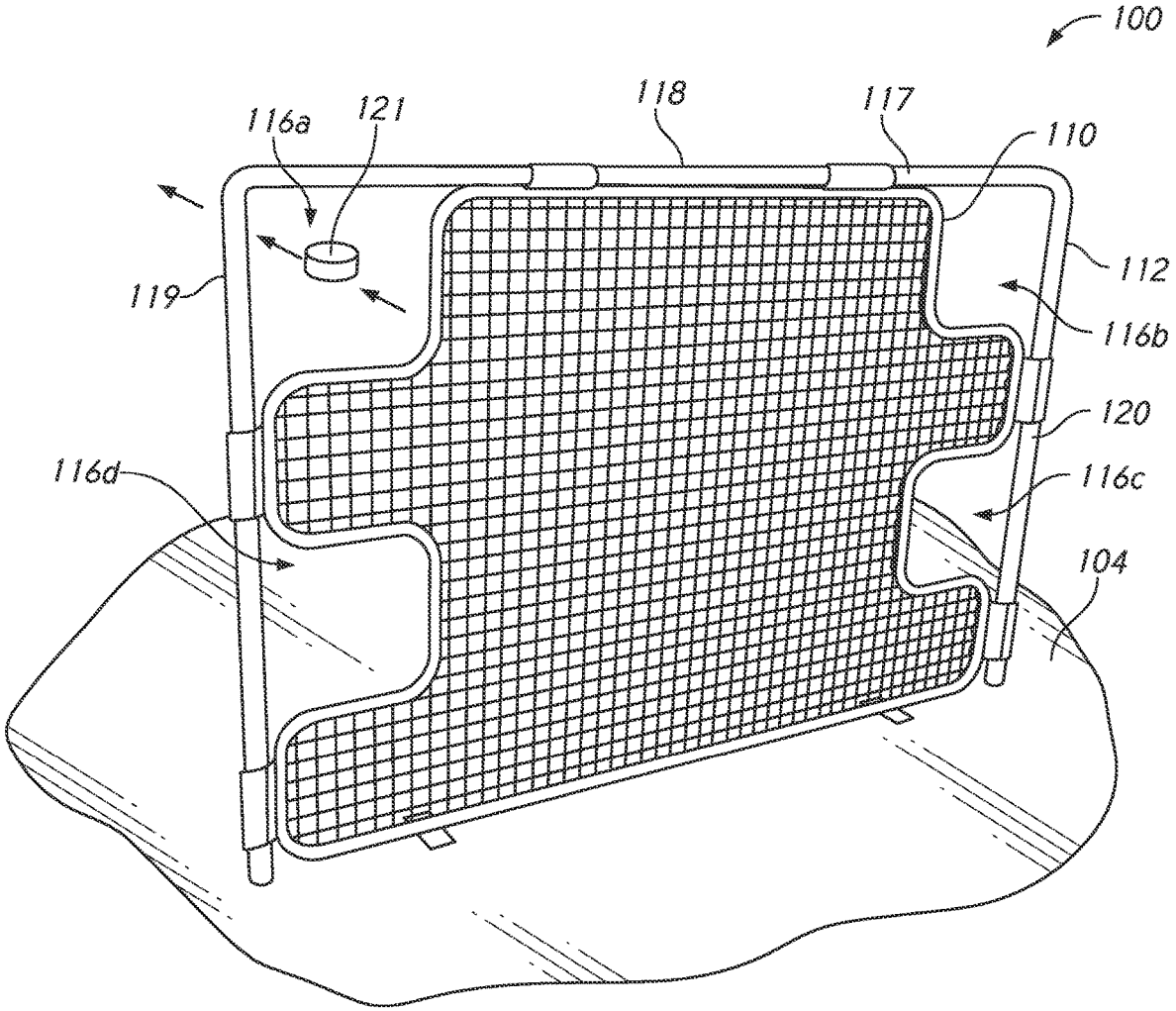
FIG. 1 is a perspective view of a goal shooting system on a playing surface in accordance with an embodiment of the technology.

FIG. 1 is a perspective view of a goal shooting system 100 on a playing surface 104 in accordance with an embodiment of the technology. The goal shooting system 100 can include a goal shooting target 110 ("shooting target 110") and a sports goal 112. The shooting target 110 is configured to deflect objects shot at an opening of the sports goal 112. A player can shoot objects at target areas or openings 116*a*, 116*b*, 116*c*, 116*d* (collectively "target openings 116") located between the shooting target 110 and the sports goal 112. The shooting target 110 can be secured to a frame 117 of the sports goal 112 and can prevent a playing object (e.g., a hockey puck) from entering the sports goal 112. Hockey pucks can be shot at the target openings 116 to develop shooting skills. FIG. 1 shows a hockey puck 121 passing through the target opening 116*a*. The profile of the shooting target 110 can correspond to an area typically blocked by a goalie to help players develop skill in shooting to desired scoring areas.

To assemble the goal shooting system 100, the shooting target 110 can be placed on the support surface 104. A crossbar 118 of the sports goal 112 can be placed upon the shooting target 110 to captively hold the shooting target 110 on the support surface 104. The shooting target 110 can engage posts 119, 120 to prevent the shooting target 110 from passing through or moving away from the opening of the sports goal 112. To disassemble the goal shooting system 100, the sports goal 112 can be lifted off of the shooting target 110, which can be disassembled, folded, or otherwise reconfigured for convenient transport and storage.

Figure 2:
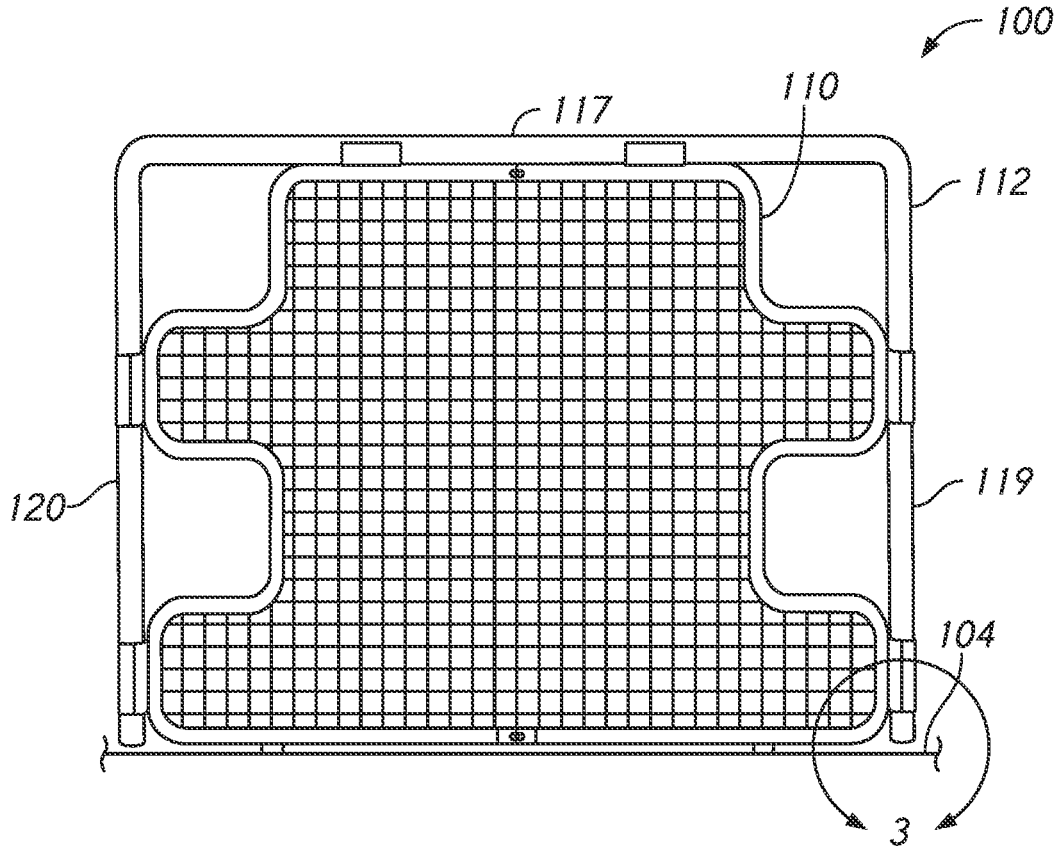
FIG. 2 is a front view of the goal shooting system of FIG. 1.
Figure 3:
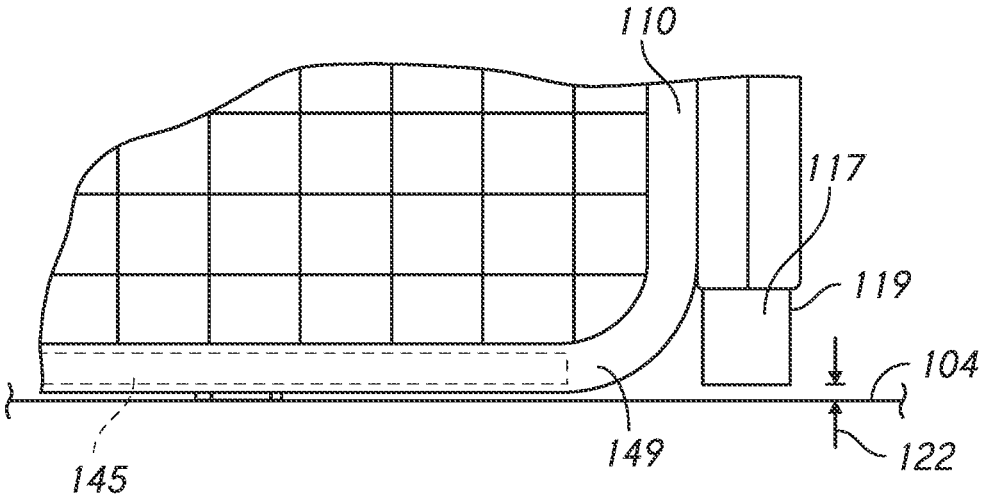
FIG. 3 is a detailed view of a portion of the goal shooting system.

FIG. 2 is a front view of the goal shooting system 100. FIG. 3 is a detailed view of a portion of the goal shooting system 100. The shooting target 110 can hold the frame 117 spaced apart from the support surface 104 such that the mass of the frame 117 provides downward pressure onto the shooting target 110. Referring now to FIG. 3, the post 119 can be spaced apart from the support surface 104 a distance 122 equal to or greater than about 0.1 inch (2.5 mm), 0.25 inch (6.4 mm), 0.5 inch (13 mm), 0.75 inch (19 mm), 1 inch (25 mm), or another suitable distance. The posts 119, 120 can be held at the same height or different heights. The goal shooting system 100 can be installed without damaging or affecting the underlying support surface 104. The frame 117 can be held close to the surface 104 such that use of the shooting target does not increase the size of the opening of the sports goal an appreciable amount.

Goal posts are often secured to playing surfaces via spikes. Although the posts 119, 120 can be held above the support surface 104 without being anchored to the support surface 104 via, for example, spikes for convenient installation, the posts 119, 120 can also be connected to the support surface 104 via spikes or other connectors.

Figure 4:
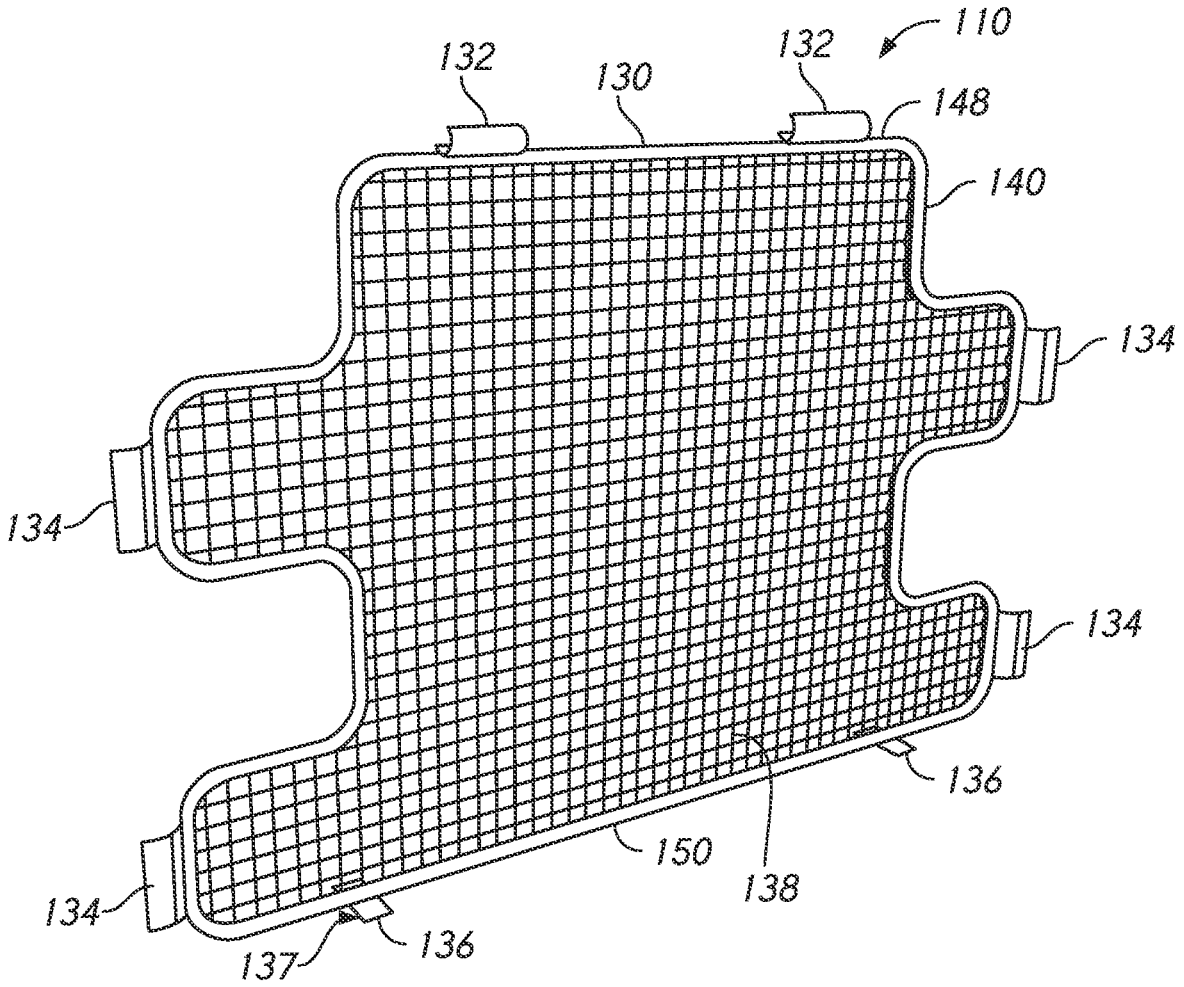
FIG. 4 is a perspective view of a goal shooting target in accordance with an embodiment of the technology.

FIG. 4 is a perspective view of a goal shooting target 110 in accordance with an embodiment of the technology. The shooting target 110 can include an obstruction assembly or panel 130 ("panel 130") for blocking playing objects, crossbar seats 132 for supporting a crossbar, arms 134 for engaging posts, and feet 136 for resting on support surfaces. The crossbar seats 132 are coupled to the panel 130 and are configured to carry a crossbar of a sports goal such that panel 130 and the sports goal define at least one target opening. The feet 136 are coupled to the panel 130 and are configured to rest on a support surface to keep the panel 130 at an upright position. For example, the panel 130 can be held at a substantially vertical position, which refers to a position within ranges of small angles from vertical, for example, angles between about 1 degree and 5 degrees from vertical (e.g., angles between about 1 degree and about 2.5 degrees, angles between about 2.5 degrees and about 5 degrees, or the like). In particular embodiments, the panel 130 is held substantially vertical such that axes of its posts 119, 120 (FIG. 3) will be at an angle with respect to a horizontal support surface of between about 90 degrees and about 95 degrees, about 90 degrees and about 93 degrees, or about 90 degrees and about 92 degrees. The panel 130 can also be installed at other orientations based on the skills to be developed.

The panel 130 can have a rounded polygonal shape and can obstruct most of an area of an opening of the sports goal and can include a material 138 and a frame 140. In some embodiments, the panel 130 is a generally planar or non-planar structure with a periphery for defining target areas at the upper corners and sides of the goal. For example, the panel 130 can have an profile generally corresponding to the butterfly position or standing position of a hockey goalie. In non-reconfigurable embodiments, different panels can be installed in a goal to practice different shots. In reconfigurable embodiments, the frame 140 can be reconfigured to change the shape of the panel 130. For example, tubular members (e.g. fixed length tubes, telescoping tubes, adjustable length tubes, etc.) of the frame 140 can be coupled together to provide installation flexibility.

The material 138 can be netting or other flexible material, such as canvas, sufficiently strong to block playing objects. The material 138 can be attached to the frame 140 via ties, hook and loop fastener, clips, clamps, etc. and can be netting laced to or otherwise coupled to the frame 140 with one or more cords (e.g., medium nylon cords, cotton cords, etc.) that are No. 21 or larger. In one embodiment, the netting 138 is made of knotless nylon comprised of heat set, resin treatment twine (e.g., 0.197 inch (5 mm) diameter) or equivalent braided twine of multifilament nylon with a break strength of, for example, about 550 to about 600 pounds (about 2.45 kilonewtons to about 2.67 kilonewtons). The size of the mesh can be about 2.5 inches (inside measurement) from each diagonal corner of nylon cord, which is no smaller in size than No. 21. The mechanical characteristics, length, and number of cords can be selected based on the characteristics (e.g., mass, hardness, etc.) of the playing object, as well as the anticipated speed of the playing object.

Protective padding may be laced around the bottom of the tubular frame 140 in such a way as to protect the material 138 from being cut, broken, or otherwise damaged. The protective padding can be a skirt (e.g., a skirt made of heavy nylon fabric or heavyweight canvas), panels (e.g., foam or rubber panels), or the like. For example, the padded skirt can be detachably coupled to the lower portion of the frame 140 and cover a portion of the material 138. The skirt can help prevent skates from becoming tangled with or cutting the material 138. In other embodiments, protective padding can be integrated into the material 138 and can extend across the bottom of the panel 130. The protective padding can help deflect objects while also inhibiting or limiting damage to the panel 130.

With continued reference to FIG. 4, the frame 140 can have a one-piece or multi-piece construction and can be made, in whole or in part, of metal, plastic, composites, or combinations thereof. In embodiments for use with relatively hard objects (e.g., hockey pucks), the frame 140 can be a tubular frame made of metal capable of withstanding significant impact forces. One material suitable for use with regulation hockey goals is 1 inch schedule 40 (e.g., 1.315 inch outer diameter, 0.133 inch thick wall, etc.) steel or aluminum pipe. In embodiments for use with relatively soft objects (e.g., rubber balls, tennis balls, etc.), the frame 140 can be made of plastic (e.g., plastic tubing), aluminum, and other lightweight material. The type of material and dimensions (e.g., diameter and thickness) of tubing can be selected such that the frame 140 has mechanical properties suitable to withstand the impact of shots while not being too heavy to make handling the frame 140 impractical.

The frame 140 can be made of circular tubing, square tubing, rectangular tubing, and other tubing. It will be appreciated that the frame 140 may have surface finishes and treatments, such as being painted, plated, or have another finishing such as powder coat and the like. According to some embodiments, one or more layers of shock absorbing material (e.g., optional shock absorbing material 145 shown in FIG. 3) can be used on a face 149 of the frame 140 to absorb impact from playing objects. The shock absorbing material can be a mono- or multi-layer structure comprising silicon, rubber, or other suitable compliant material. Adhesives, fasteners, or other coupling features can be used to couple the shock absorbing material to the frame 140. The thickness of the tubes of the frame 140 can be reduced if a shock absorbing material is used.

Referring to FIG. 4, the crossbar seats 132 can be coupled to a top 148 of the frame 140 and can be sized and configured to carry crossbars of sports goals. According to some embodiments, the crossbar seats 132 can be generally curved to match a portion of the crossbar. The complementary shapes help limit or minimize movement of the sports goal and keeps the crossbar from inadvertently dislodging from the crossbars seat 132 as discussed in connection with FIGS. 6 and 7. The crossbar seats 132 can have a partially circular, partially elliptical, or polygonal cross-sectional profile. For example, crossbar seats 132 with partially circular cross-section profiles are well suited to receive and hold a crossbar with a generally circular cross-sectional profile. The polygonal crossbar seats 132 can be used to hold a crossbar with a polygonal cross section. The configuration, position, and number of crossbar seats can be selected based on the dimensions and configuration of the frame 140.

The feet 136 can be secured to a bottom 150 of the tubular frame 140 to provide standing support for the shooting target 110. Each foot 136 can extend outwardly from opposite sides of the panel 130 to keep the panel 130 from tipping over. In some embodiments, the length of the feet 136 can be equal to or greater than 2×, 3×, 3× or 5× the thickness of the frame 140 and can be equal to or longer than 2 inches (50 mm), 3 inches (76 mm), 4 inches (101 mm), 6 inches (152), 7 inches (178 mm), or another suitable length. The feet 136 can include one or more mounts, rubber bumpers, spikes, or friction features that protect and separate the bottom of the feet 136 from a playing or storage surface, such as, for example, a rough concrete or asphalt surface. In embodiments with removable feet 136, either foot 136 can be removed and one or more mounts, rubber bumpers, stands, or the like could be secured to the bottom 150 of the frame 140.

The underside surfaces of the feet 136 may include one or more anchors 137 (one illustrated) to help secure the feet 136 to the playing surface, such as ice surface in the case of hockey or grass in the case of soccer and lacrosse. For use on ice surfaces, the anchors 137 can be ice-penetrating anchors. Bottom surfaces of the feet 136 can be substantially flush with the ice surface when the ice-penetrating anchors are seated in the support surface. For use on grass surfaces, the anchors 137 can be long spikes for insertion into the grass. It will be appreciated that the anchors can be made of different materials, such as aluminum, steel, or the like. The anchors can be made of stainless steel to avoid or limit rust. Anchors suitable of the feet 136 are discussed in connection with FIGS. 24 to 28. In other embodiments, the bottom surfaces of the feet 136 can be featureless to minimize or limit marring of support surfaces (e.g., a hardwood floor).

Figure 5:
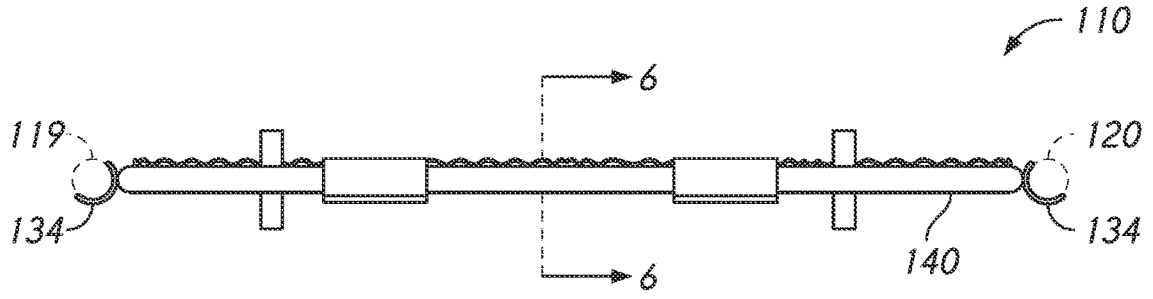
FIG. 5 is a top view of the goal shooting target of FIG. 4.

FIG. 5 is a top view of the shooting target 110. The side arms 134 can be curved so that they generally match the curved outer surface of the sports goal posts 119, 120 (illustrated in dashed line). Side arms 134 with half pipe sections can receive and hold tubular goal posts 119, 120 with a generally round cross-sectional profile. According to some embodiments, the side arms 134 have flat portions that sit flat against a front portion of the sports goal posts 119, 120. In some embodiments, the arms 134 have both flat and curved portions that cooperate to keep the shooting target 110 within the opening of the sports goal.

The side arms 134 can prevent or limit movement of the tubular frame 140 relative to the sports goal. When the goal shooting target 110 is impacted by a playing object (e.g., a puck or a ball), the shooting target 110 is not displaced from its location at the opening of the sports goal. According to some embodiments, a layer of shock absorbing material (e.g., silicon, rubber, etc.), dampeners, or other interface elements can be secured to surfaces of the side arms 134 that face the goal posts 119, 120 to limit or reduce vibrations, noise, or the like. Although the illustrated embodiment has four spaced apart side arms 134, the number and positions of the side arms can be selected based on the configuration of the sports goal.

Figure 6:
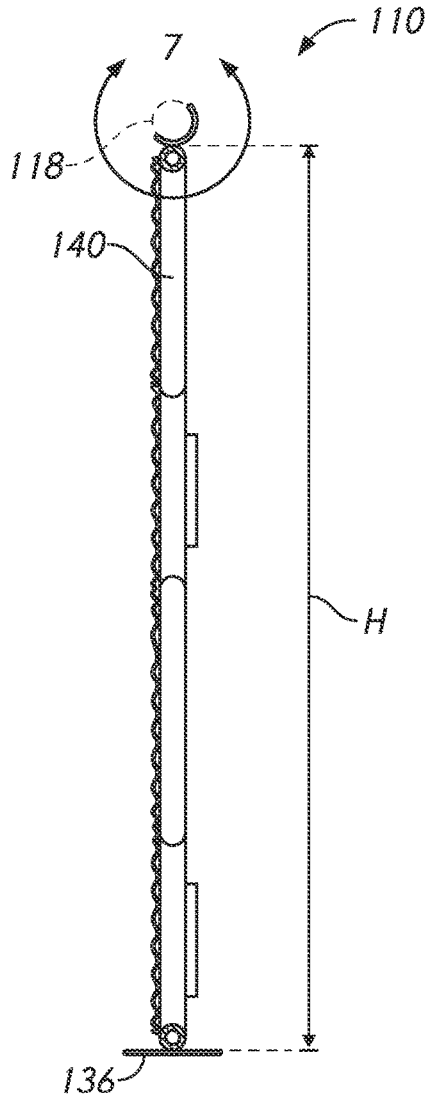
FIG. 6 is a cross-sectional view of the goal shooting target taken along line 6-6 of FIG. 5.

FIG. 6 is a cross-sectional view of the goal shooting target 110 taken along line 6-6 of FIG. 5. A height H of the goal shooting frame 140 can be at least slightly greater than the height of the opening and/or height of the crossbar of the sports goal frame. In use, the sports goal frame can be lifted, and the crossbar of the sports goal can then be set down onto the crossbar seats 132. At least the front portion of the sports goal frame would remain lifted from the support surface, as shown in the examples in FIGS. 2 and 3. The crossbar 118 (illustrated in dashed line) of the playing goal applies a downward force on the crossbar seats 132 to captively hold the shooting target 110 to prevent movement of the sports goal system for extended periods of time even when blocking objects that are shot at relatively high speeds. In some installations, most of the mass of the goal frame is supported by the crossbar seats 132. For example, 60%, 70%, 80%, 90%, 95%, or 100% of the combined mass of the crossbar and posts (e.g., crossbar 118 and posts 119, 120 in FIG. 1) is carried by the seats 132. Additional weights can be mounted on, couple to, or integrated into the goal shooting target 110 to help limit, minimize, or substantially prevent movement. Additionally, the crossbar seat 132 can hold the crossbar 118 generally above the feet 136 such that the downward force applied by the crossbar 118 is generally centered over the feet 136. This helps stabilize the shooting target 110 to inhibit, limit, or prevent appreciable tilting of the shooting target 110 during use.

Figure 7:
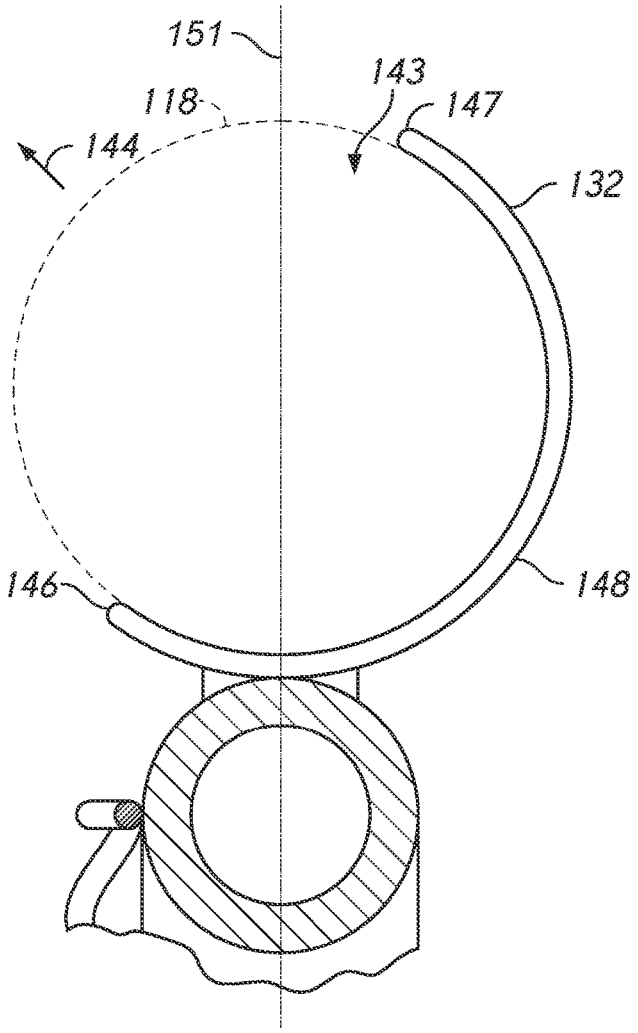
FIG. 7 is a detailed view of an upper portion of the goal shooting target.

FIG. 7 is a detailed view of an upper portion of the goal shooting target. The description of one of the crossbar seats 132 applies to the other crossbar seat. The crossbar seat 132 can have an open U-shaped channel to provide support to the goal shooting frame by restricting movement (e.g., forward and backward movement) of the goal shooting target 110. According to some embodiments, a layer of shock absorbing material, such a rubber, may be secured to the surface of the crossbar seat 132 that faces the crossbar to limit vibrations, noise, etc.

The crossbar seat 132 can include a rigid arcuate member configured to receive and extend along opposite sides of the crossbar 118. For example, the crossbar seat 132 can be in the form of a metal half pipe having a curvature that generally matches the curvature of the crossbar 118. In some embodiments, the crossbar seat 132 can have a first edge 146, a second edge 147, and an arcuate main body 148 therebetween. The edges 146, 147 can be spaced apart from one another to define the crossbar-receiving gap 143. To install the crossbar 118, it can be passed through the crossbar-receiving gap 143 until the bottom of the crossbar is supported by the crossbar seat 132. As shown in FIG. 7, the crossbar seat 132 extends rearwardly past a center plane 151 of the crossbar 118 and upwardly along a section of the crossbar 118. To disassemble the goal system, the crossbar 118 can be lifted up and moved away from the crossbar seat 132, as indicated by arrow 144.

Figure 8:
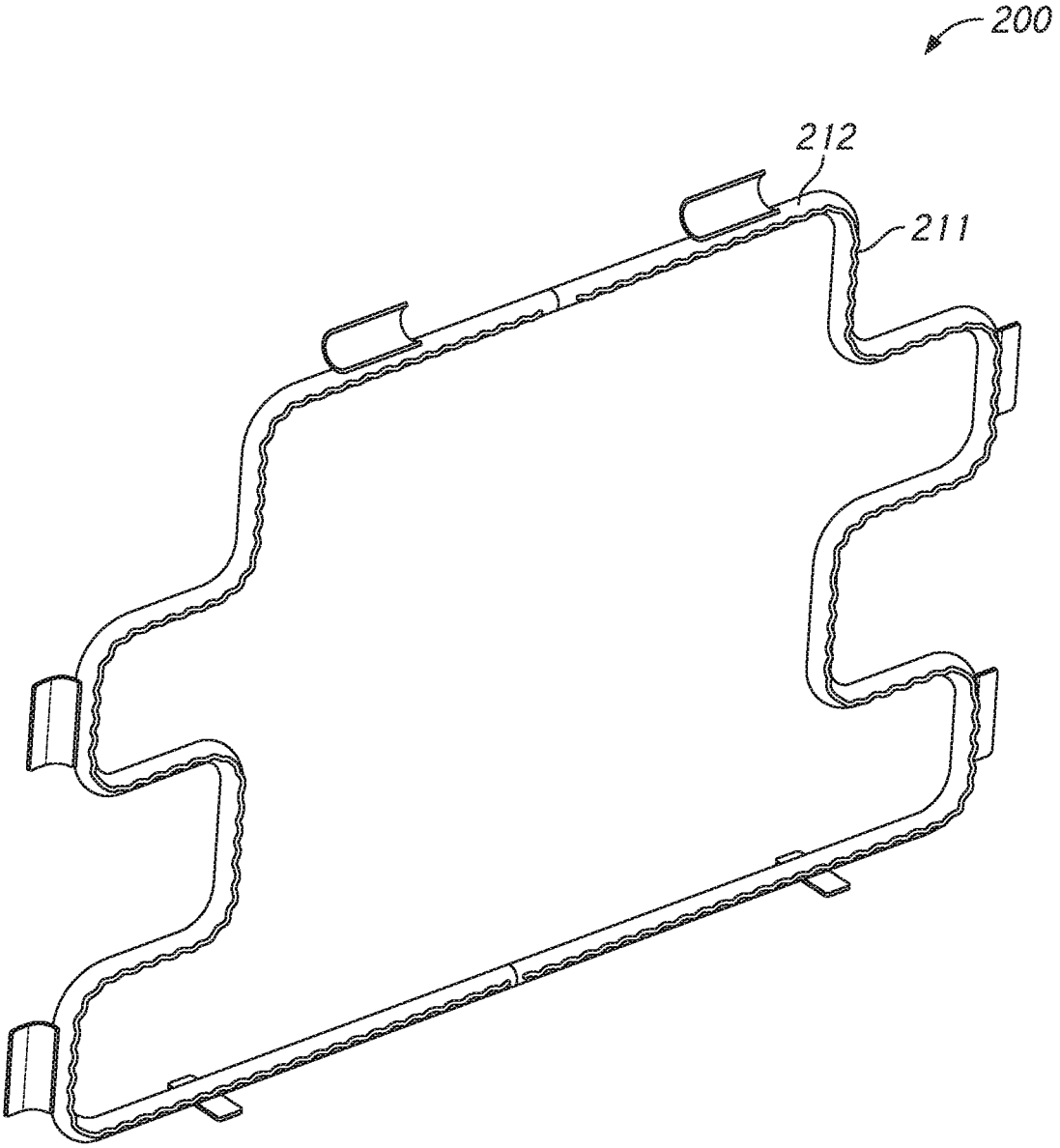
FIG. 8 is a top, rear isometric view of a goal shooting target (netting omitted) in accordance with an embodiment of the technology.
Figure 9:
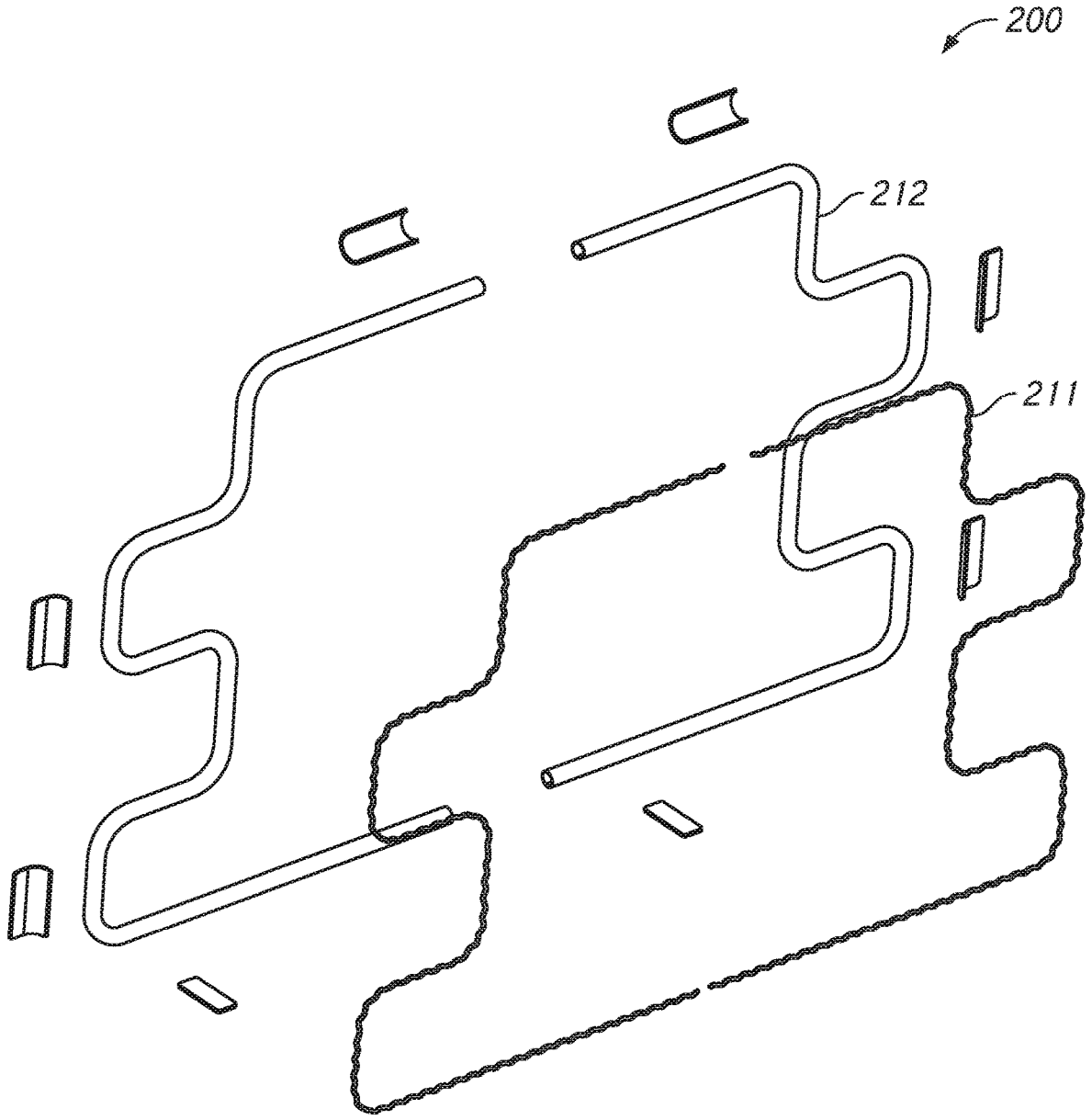
FIG. 9 is an exploded isometric view of the goal shooting target of FIG. 8.
Figure 10:
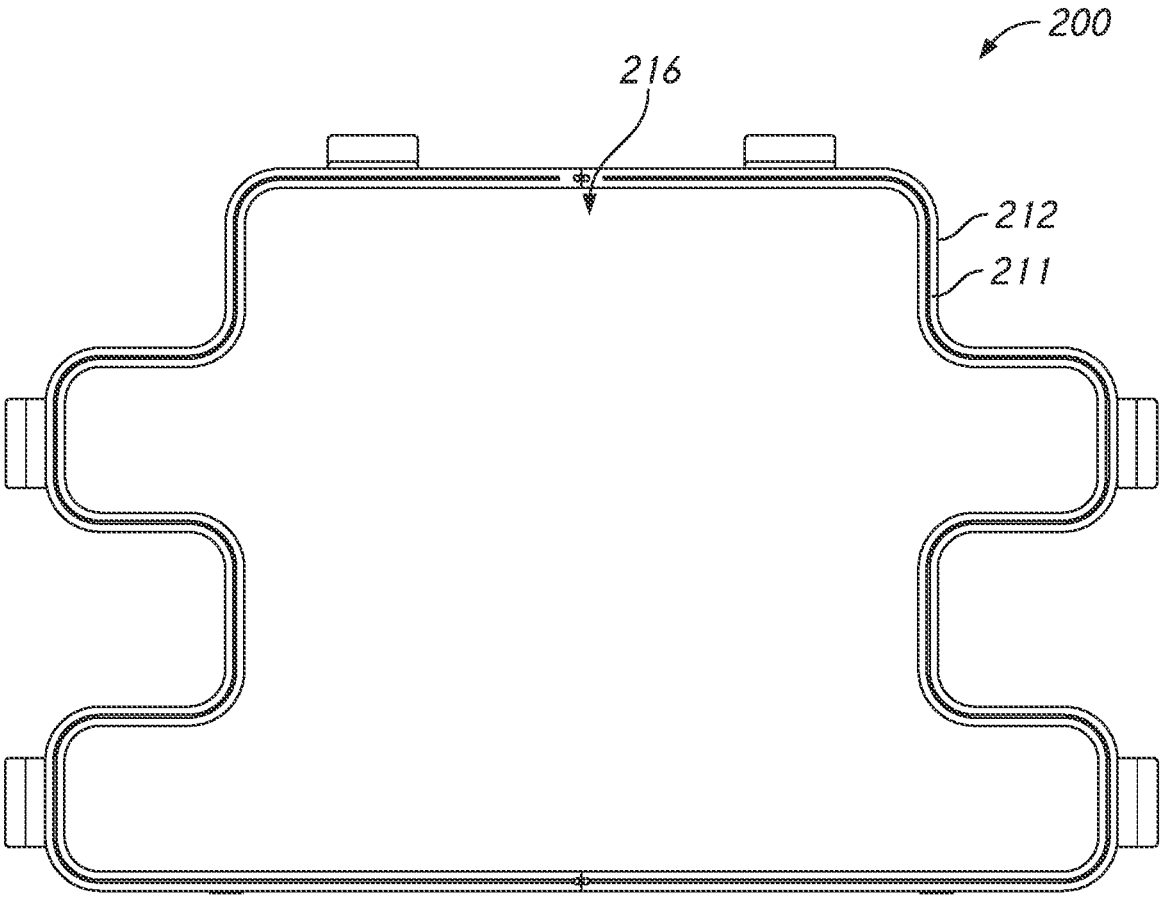
FIG. 10 is a rear view of the goal shooting target of FIG. 8.

FIG. 8 is a top, rear isometric view of a goal shooting target 200 (netting omitted) in accordance with an embodiment of the technology. FIG. 9 is an exploded isometric view of the goal shooting target 200. FIG. 10 is a rear view of the goal shooting target 200. Referring to FIGS. 8 to 10, the goal shooting target 200 includes a net tie bar 211 coupled to a back side of a tubular frame 212 by welding, fasteners, or the like. Netting can be attached to the net tie bar 211 to prevent playing objects from passing through an area 216 (FIG. 10) of the shooting frame 212.

Figure 11:
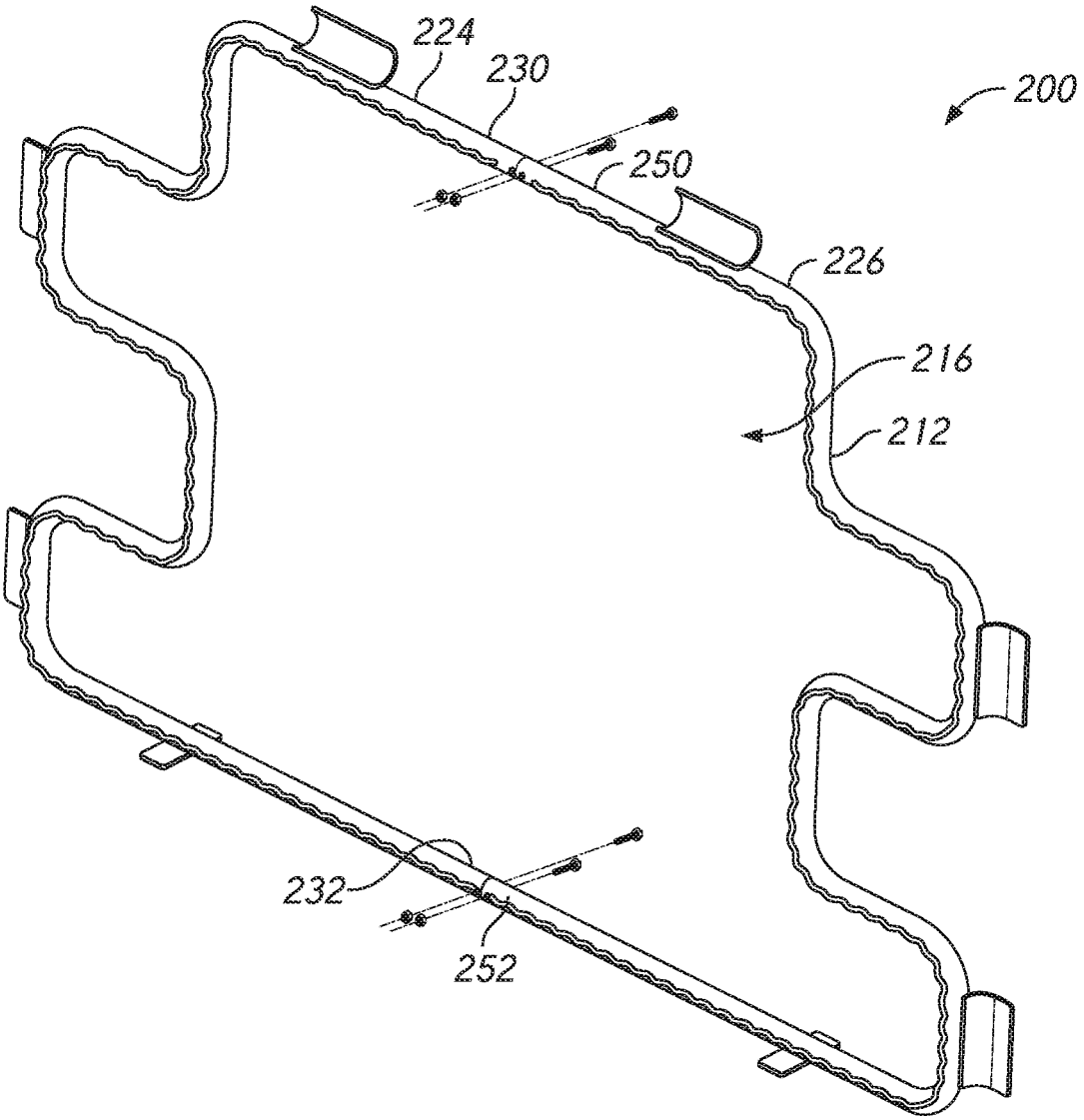
FIG. 11 is a top, rear isometric view of a goal shooting target in accordance with an embodiment of the technology.
Figure 12:
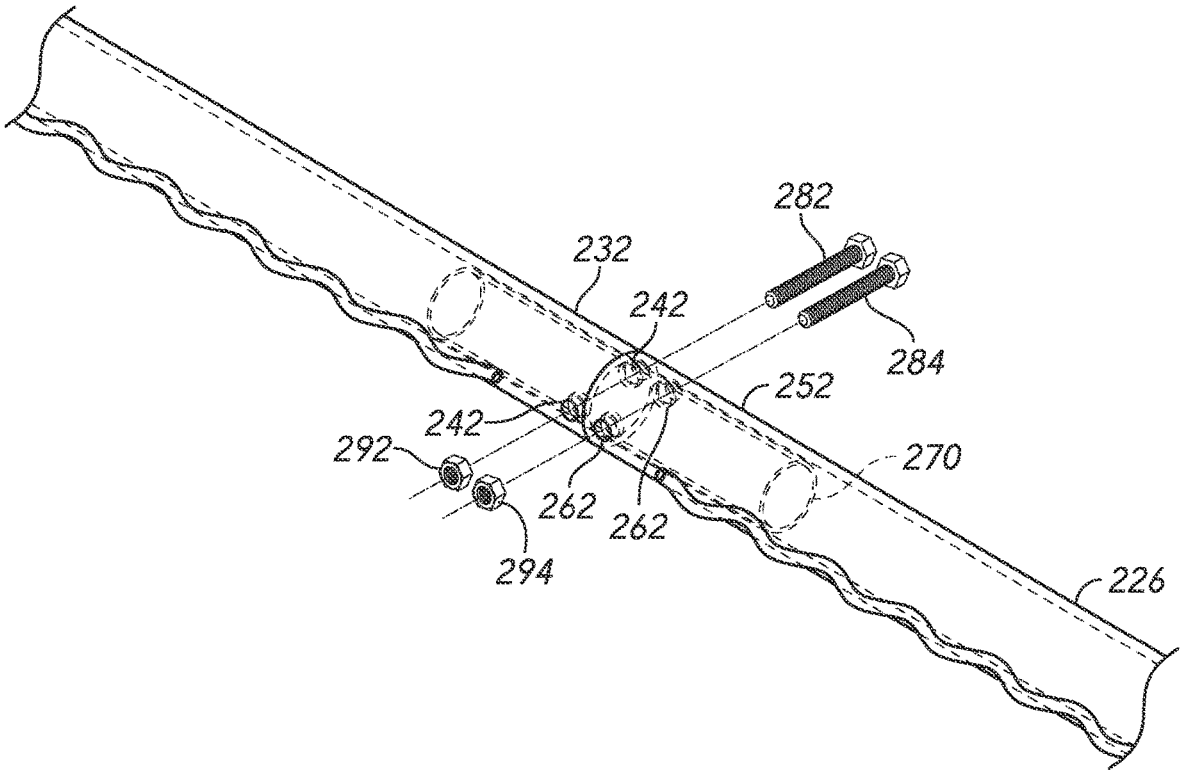
FIG. 12 is an isometric view of a portion of a goal shooting target in accordance with an embodiment of the technology.
Figure 13:
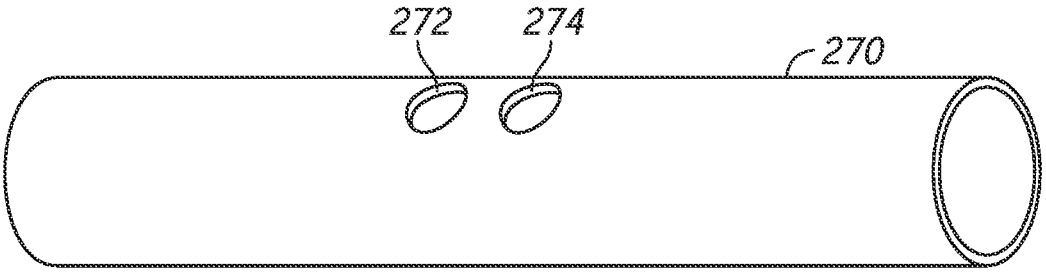
FIG. 13 is a front view of a connector in accordance with an embodiment of the technology.
Figure 14:
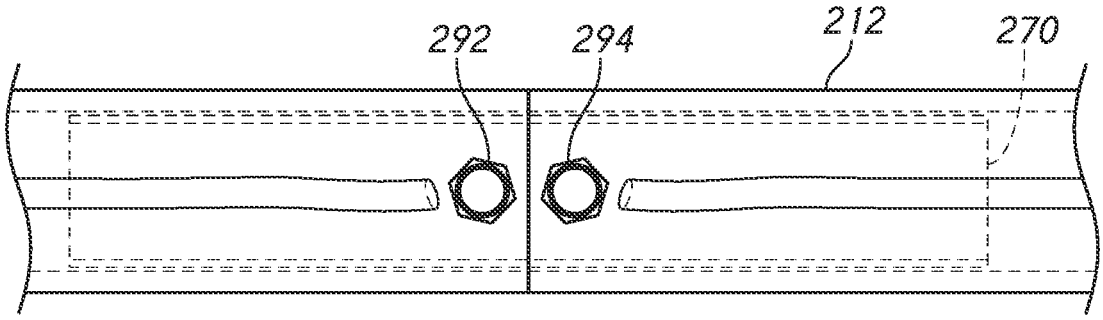
FIG. 14 is a front view of a connection interface of a portion of a goal shooting target in accordance with an embodiment of the technology.

FIG. 11 is a top, back isometric view of the goal shooting target 200. The tubular frame 212 can include two or more separate components that can be coupled together. For example, the tubular frame 212 can be divided into two components 224 and 226. The component 224 has ends 230, 232 with through holes. The component 226 has ends 250, 252. Referring to FIG. 12, the ends 232, 252 have through holes 242, 262, respectively. The ends 230, 250 can have a similar arrangement of through holes. A sleeve 270 can be inserted into each of the ends 232 and 252 of the tubular frame 226. Holes 272 and 274 (FIG. 13) of the sleeve 270 can be aligned with the fame holes 242 and 262, respectively. A fastener 282 can be inserted through the holes 242, 272, and a fastener 284 can be inserted through the holes 274, 262. Nuts 292, 294 can be secured the fasteners 282, 284, respectively. FIG. 14 shows the installed sleeve 270. Other fastener arrangements can be used to couple together the ends 232, 252. For example, pins (e.g., cotter pins), snaps, hinges, or the like can be used to couple together components of the frame. In some embodiments, components of the frame disclosed herein can be assembled using a splice lock or other similar connection.

Figure 15:
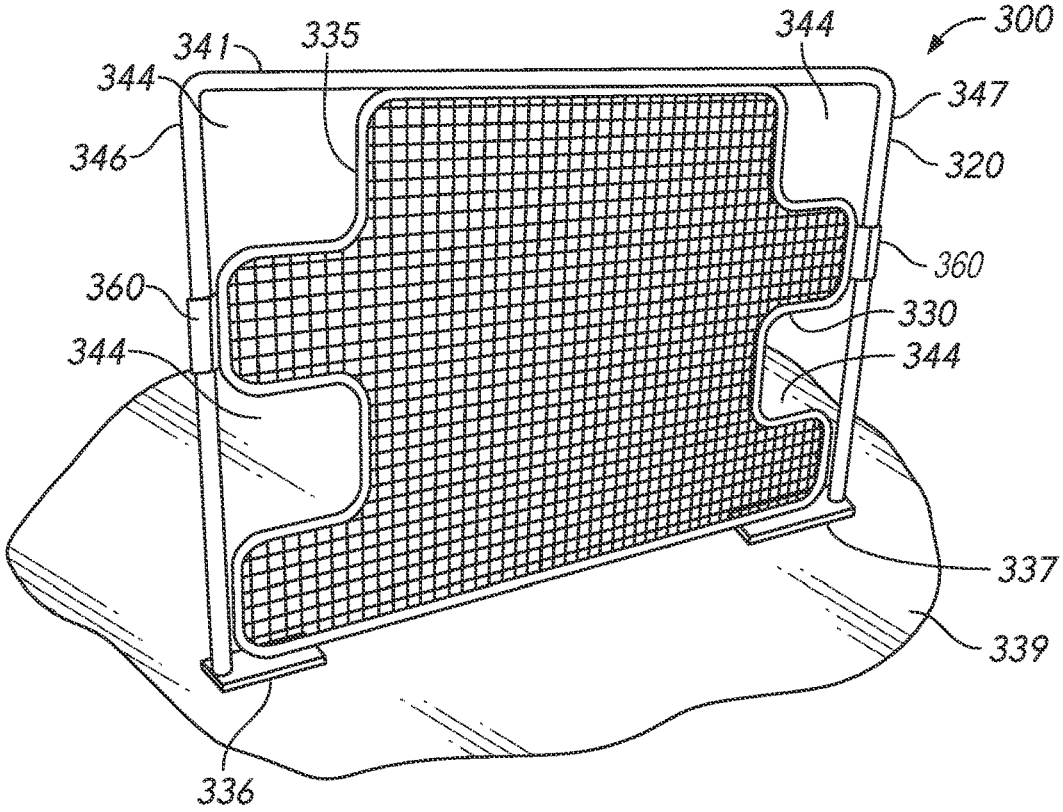
FIG. 15 is a perspective view of a goal shooting system on a playing surface in accordance with an embodiment of the technology.

FIG. 15 is a perspective view of a goal shooting system 300 on a playing surface 339 in accordance with an embodiment of the technology. The goal shooting system 300 can include a sports goal 320 and a goal shooting target 330. The goal shooting target 330 can include a panel 335 and sports goal supports 336, 337 coupled to the panel 335. The sports goal supports 336, 337 are configured to carry at least a portion of the sports goal 320 such that posts 346, 347 are held off of the support surface 339. A player can shoot objects through target openings 344 defined between the panel 335 and the sports goal frame 341 while the sports goal 320 captively holds the shooting target 330 on the support surface 339.

Figure 16:
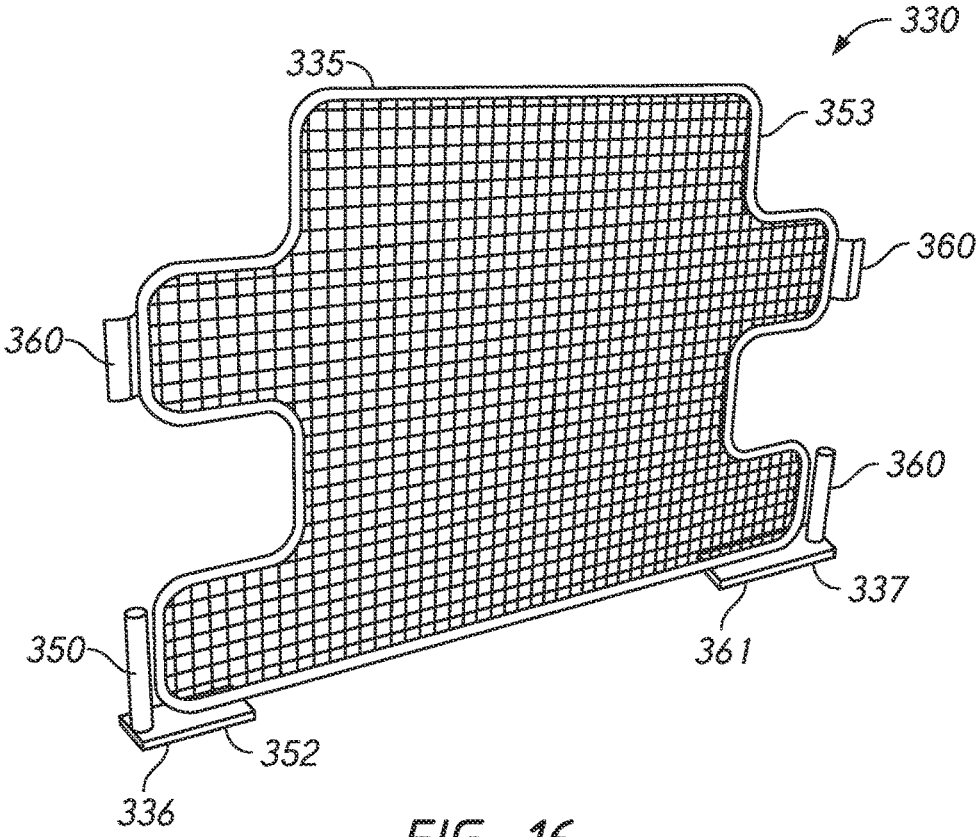
FIG. 16 is a perspective view of a goal shooting target suitable for the goal shooting system of FIG. 15.

FIG. 16 is a perspective view of a goal shooting target 330 suitable for the goal shooting system of FIG. 15. The goal support 336 can include an elongate member or post holder 350 ("post holder 350") and a plate or base 352 ("base 352"). The post holder 350 is configured to be inserted into the post (e.g., post 346 in FIG. 15). The base 352 connects the post holder 350 to a frame 353 of the panel 335. The goal support 337 can include an elongate member or post holder 360 ("post holder 360") and a plate or base 361 ("base 361"). The post holder 360 is configured to be inserted into the post (e.g., post 347 in FIG. 15). The base 361 connects the post holder 360 to the frame 353. The bases 352, 361 can lay flat on a horizontal support surface to keep the panel 335 at a vertical or upright position. The goal frame can be lifted and the tubular goal frame posts can then be set down over the post holders 350, 360, thereby preventing displacement of the goal shooting target.

Figure 17:
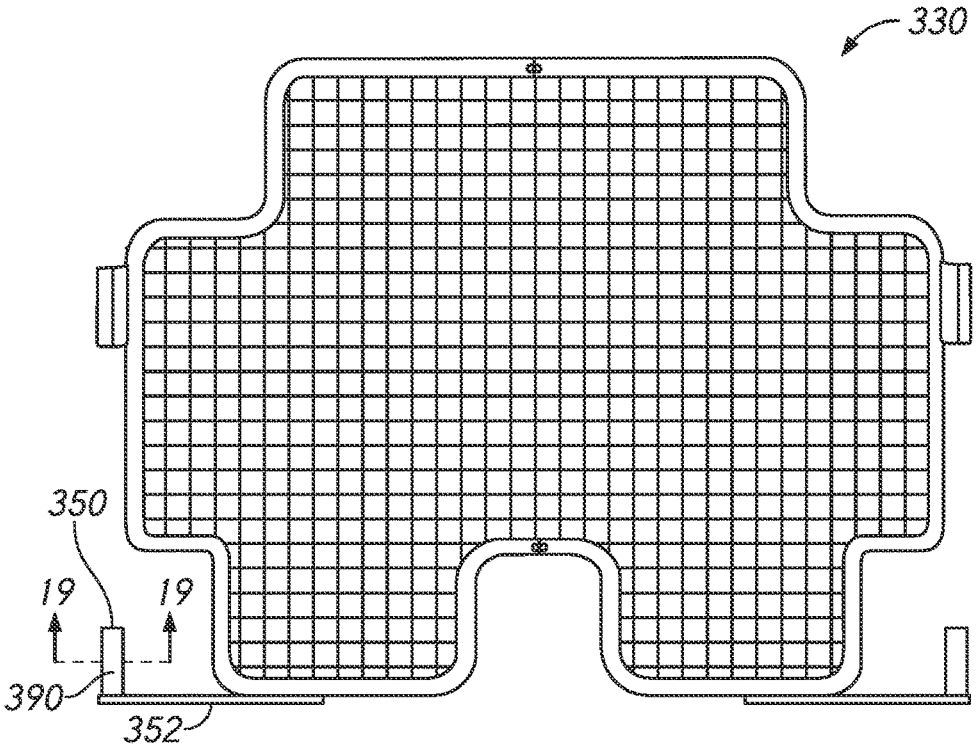
FIG. 17 is a front view of the goal shooting target of FIG. 16.
Figure 18:
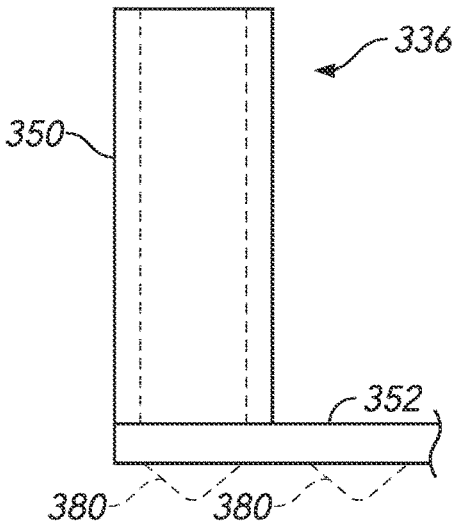
FIG. 18 is a detailed view of a post holder in accordance with an embodiment of the technology.

FIG. 17 is a front view of the goal shooting target 330. FIG. 18 is a detailed view of the goal shooting target 330 and post holder 350 in accordance with an embodiment of the technology. The underside portion of the flat base 352 may comprise securing features 380 (e.g., anchors or pegs of FIG. 18) so that the device also secures the goal shooting frame and sports goal to an ice surface or another support surface.

Figure 19:
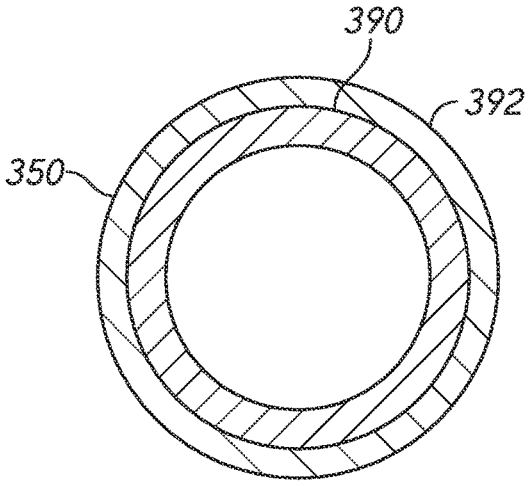
FIG. 19 is a cross-sectional view of the post holder taken along line 19-19 of FIG. 17.

FIG. 19 is a cross-sectional view of the post holder 350 taken along line 19-19 of FIG. 17. The post holder 350 can include an elongate body 390 and a dampener 392 positionable between the elongate body 390 and the post of the sports goal. The dampener 392 can be a compliant sleeve (e.g., a silicon sleeve, rubber sleeve, etc.), compliant strips adhered to the outside of the elongate body 390, or another suitable feature for absorbing energy to reduce vibrations and/or noise.

Figure 20:
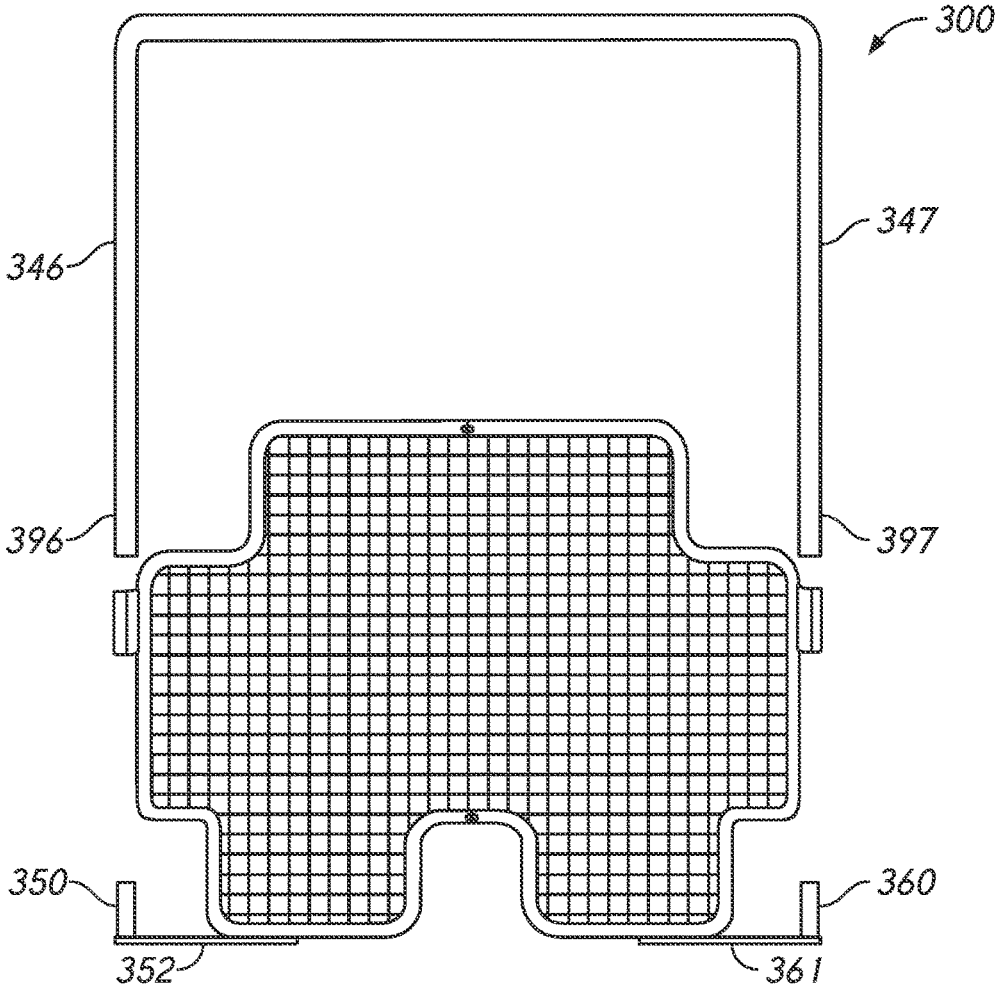
FIGS. 20 and 21 illustrate stages for assembling a goal shooting system in accordance with an embodiment of the technology.
Figure 21:
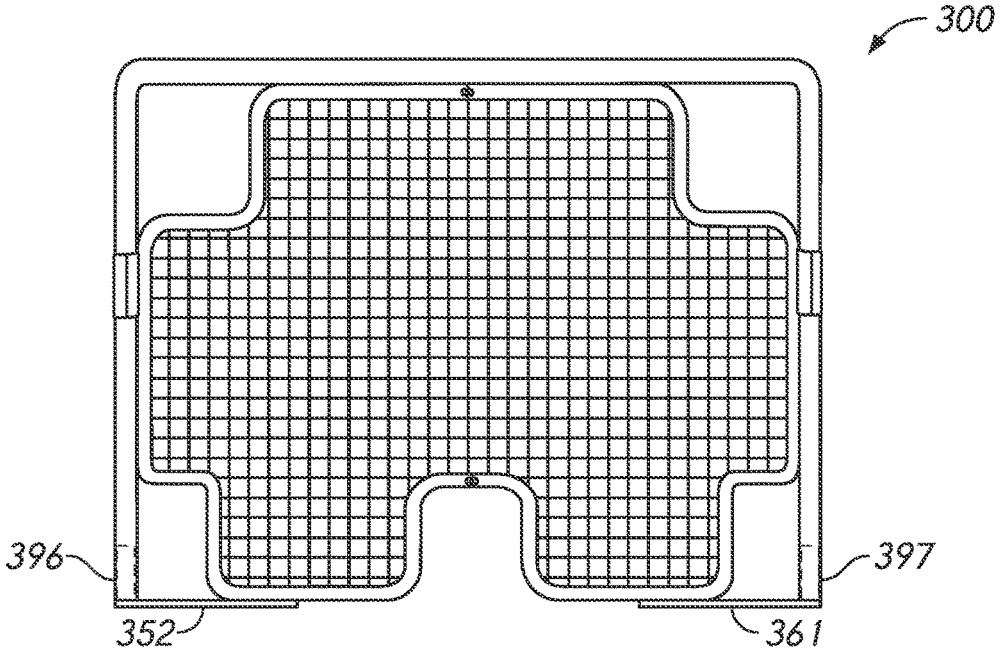

FIGS. 20 and 21 illustrate stages for installing the goal shooting system 300 in accordance with an embodiment of the technology. An end 396 of the post 346 can be positioned above the post holder 350, and an end 397 of the post 347 can be positioned above the post holder 360. The ends 396, 397 can slide over the post holders 350, 360 until they rest on the bases 352, 361.

Figure 22:
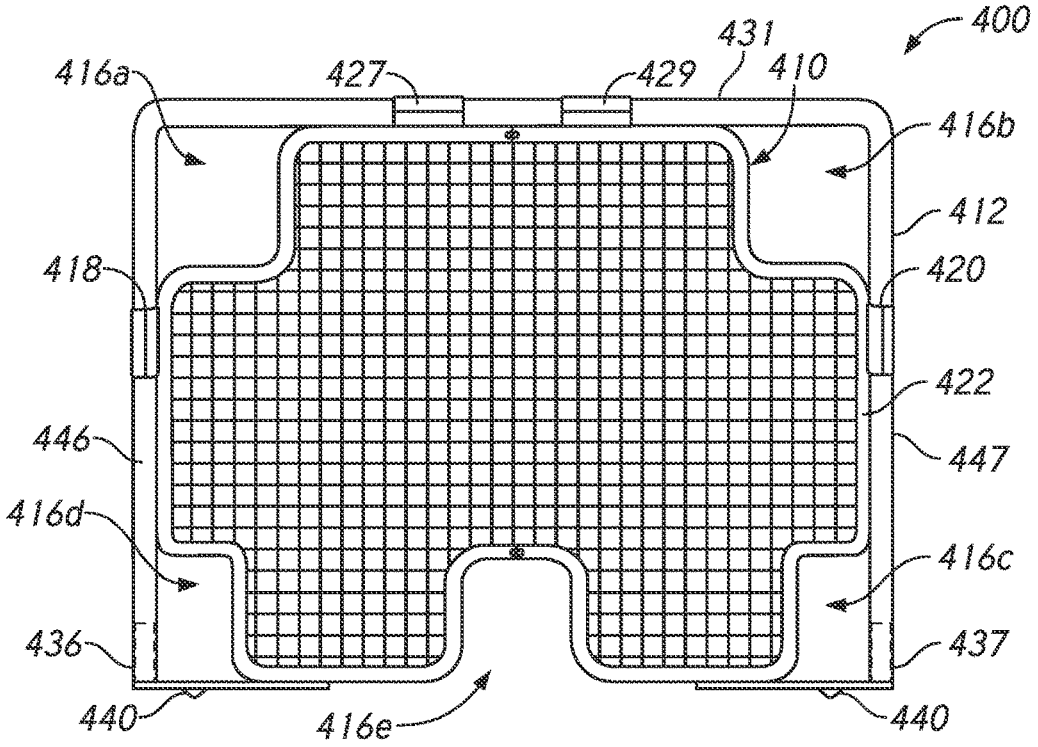
FIGS. 22 and 23 are front views of goal shooting systems in accordance with embodiments of the technology.
Figure 23:
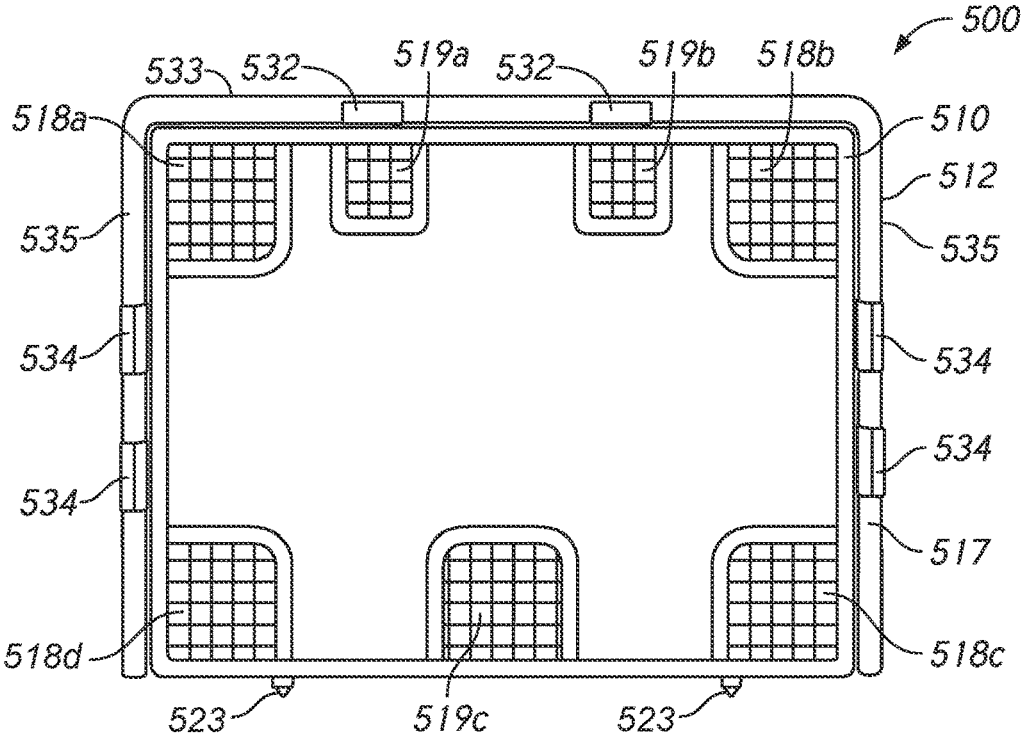

FIGS. 22 and 23 are front views of a goal shooting system 400 in accordance with various embodiments of the technology. Referring now to FIG. 22, a goal shooting system 400 can include goal shooting target 410 ("shooting target 410") and a sports goal 412. The shooting target 410 and sports goal 412 define corner target areas or openings 416*a*, 416*b*, 416*c*, 416*d* and a center lower opening 416*e*. Side arms 418, 420 couple opposite sides of a panel 422 to the sports goal 412. The panel 422 blocks most of the opening of the sports goal 412. In some embodiments, the shooting target 410 includes crossbar seats 427, 429 for supporting a crossbar 431. In another embodiment, the shooting target 410 has a single upper crossbar seat.

The goal shooting target 410 also includes sports goal supports 436, 437 coupled to the panel 422. The sports goal supports 436, 437 are configured to hold posts 446, 447 of the sports goal 412 off of a support surface upon which the goal shooting target rests. Each sports goal supports 436, 437 can include one or more anchors 440. The description of the sports goal supports discussed in connection with FIGS. 15-21 applies equally to the sports goal supports 436, 437.

FIG. 23 shows a goal shooting system 500 that includes a goal shooting target 510 ("shooting target 510") and a sports goal 512. The shooting target 510 can include a rectangular frame 517, corner blocking sections 518*a*, 518*b*, 518*c*, 518*d*, and blocking sections 519*a*, 519*b*, 519*c*. The number, positions, and configurations of the blocking sections can be selected based on the shots to be practiced. The frame 517 can have holes or other features that allow rearrangement of the blocking sections. In some embodiments, the shooting target 510 includes crossbar seats 532 for supporting a crossbar 533, side arms 534 for engage posts 535, and feet 536 for resting on support surfaces.

Figure 24:
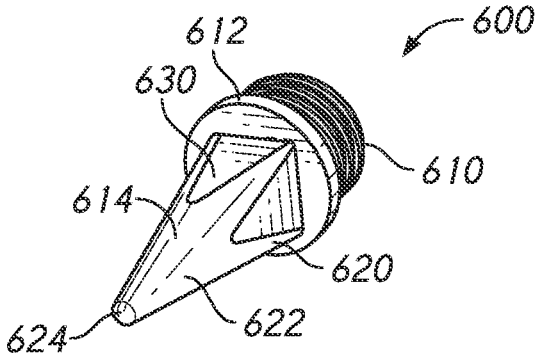
FIGS. 24 to 28 are views of anchors in accordance with embodiments of the technology.

FIG. 24 is a perspective view of an anchor 600 in accordance with one embodiment of the technology. The anchor 600 includes a mounting or proximal end 610 ("mounting end 610"), a seating portion 612, and an anchor portion 614. The mounting end 610 can include external threads configured to couple to a threaded component of the goal shooting target. In some embodiments, the mounting end 610 can be coupled to an internally threaded hole of the frame, feet, or another component of target shooting systems. It will be appreciated that any of the exemplary anchors, spikes, or cleats disclosed herein could have threaded portions. The seating portion 612 can be a flange (e.g., an annular flange) extending outwardly beyond the mounting end 610 and/or the anchor portion 614. The seating portion 612 can rest upon a playing surface when the anchor portion 614 extends into a support surface. The anchor portion 614 can be a spike, a cleat, or another anchoring feature and can include a proximal anchor end 620, a main body 622, and a distal tip 624.

The distal tip 624 is generally conical or frustoconical for insertion into an ice surface. The anchor portion 614 shown in FIG. 24 also has flattened portions 630 that can be engaged by a tool in order to tighten or loosen the anchor 600 (e.g., spike or cleat replacement or repair). The surfaces 630, as well as rounded distal ends of the anchors, spikes, or cleats, may be beneficial for safety reasons because it is less likely that a person who comes into contact with such surfaces would suffer an injury. In some embodiments, pins, mechanical fasteners, nut assemblies, or the like can be used to permanently or detachably couple the anchor 600 to another component of a shooting goal system.

Figure 25:
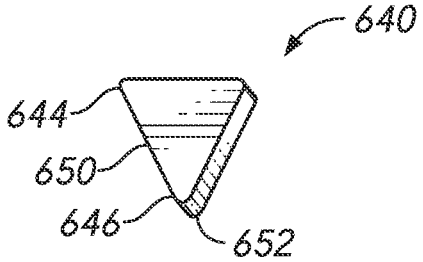

FIGS. 25-28 show various embodiments of distal portions of anchors in accordance with embodiments of the technology. These distal portions can be incorporated into the anchor 440 of FIG. 22, anchor 532 of FIG. 23 or into other anchors or coupling features disclosed herein. Referring now to FIG. 25, an anchor portion 640 includes the proximal portion 644, a distal portion 646, and a main body 650 extending between. The distal portion 646 can include a generally rounded tip 652 sufficiently sharp to pierce an ice surface but sufficiently rounded to avoid piercing a person's skin. The main body 650 can have a generally planar triangular shape.

Figure 26:
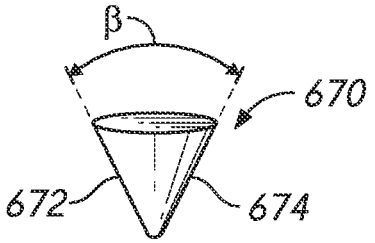

FIG. 26 is an isometric view of an anchor portion 670 having a generally conical shape. The anchor portion 670 can have a distal end 672 that terminates in a relatively sharp tip 674, which defines an included angle in the range of about 5° to 45°, 10° to 25°, or 10° to 30°. The sharp tip 674 can have other configurations selected based on the desired seating force.

Figure 27:
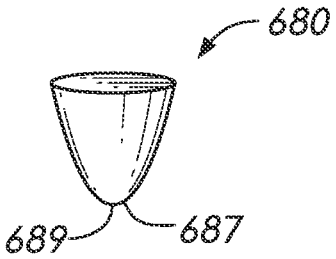

FIG. 27 is an isometric view of an anchor portion 680 with a distal portion 687 having a generally rounded tip 689. The radius of curvature of the tip 689 can be selected based on the desired force needed to drive the anchor portion 680 into a support surface.

Figure 28:
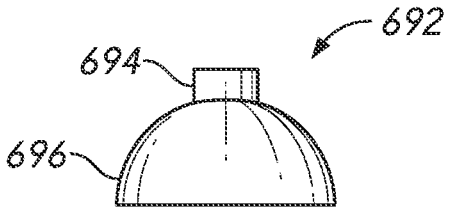

FIG. 28 is a side view of an anchor in the form of suction cup 692. The suction cup 692 can have a proximal portion 694 and a distal portion 696. The proximal portion 694 is configured to couple to a frame or foot. The distal portion 696 can be in the form of a flexible cup suitable for coupling to a generally smooth surface, such as an ice surface, synthetic ice surface, or the like. The suction cup can be made, in whole or in part, of rubber, silicone, or other compliant materials.

Anchors can be of differing shapes and sizes, as shown in FIGS. 24-28, to adequately secure the shooting targets or sports goals disclosed herein to a support surface when the goal systems are placed on surfaces. It will be appreciated that the anchors can also be made of different materials, such as aluminum, steel, or the like. For example, the anchors can be made of stainless steel to avoid rust. It will also be appreciated that spike, cleats, and/or suction cups can be secured to shooting goal targets (e.g., coupled to the tubular frame or feet) by thread engagements or other suitable means, such as, for example, by welding. According to some embodiments, the underside surface of the frame may have a plurality of untapped bores wherein nuts are aligned with the opening access of the bore and secured generally to the perimeter of the bore by welding, for example. The nuts do not need to be secured to the tubular frame. For example, the nuts could receive threaded spikes or cleats through the inside of the tubular frame.

Figure 29:
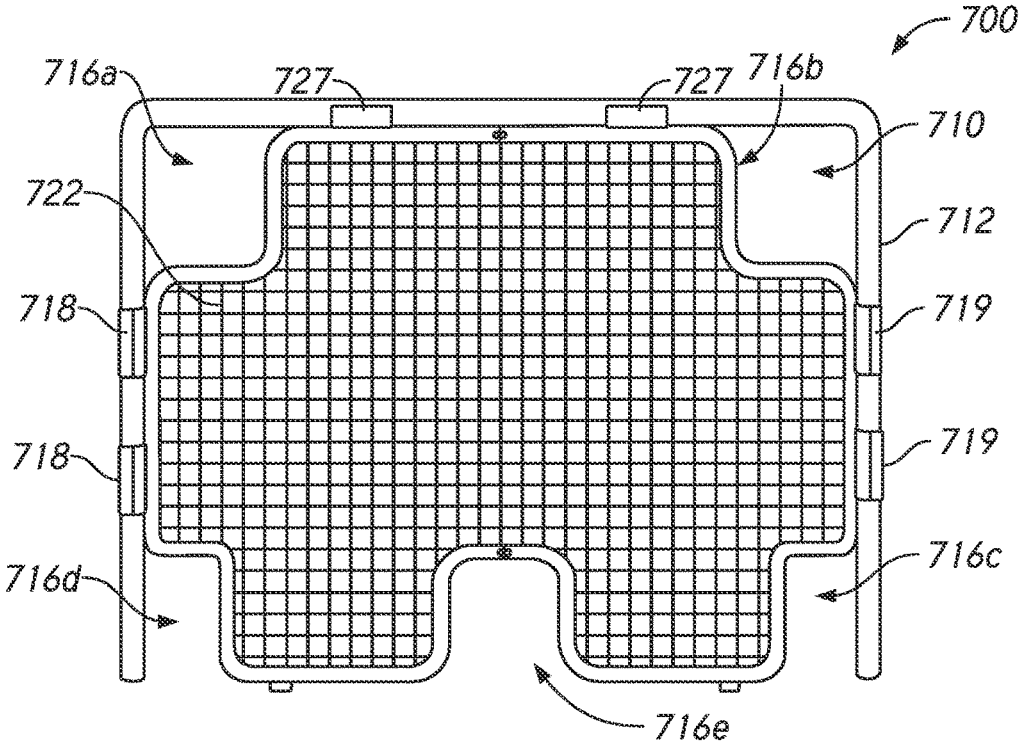
FIGS. 29 to 31 are front views of goal shooting systems in accordance with embodiments of the technology.
Figure 30:
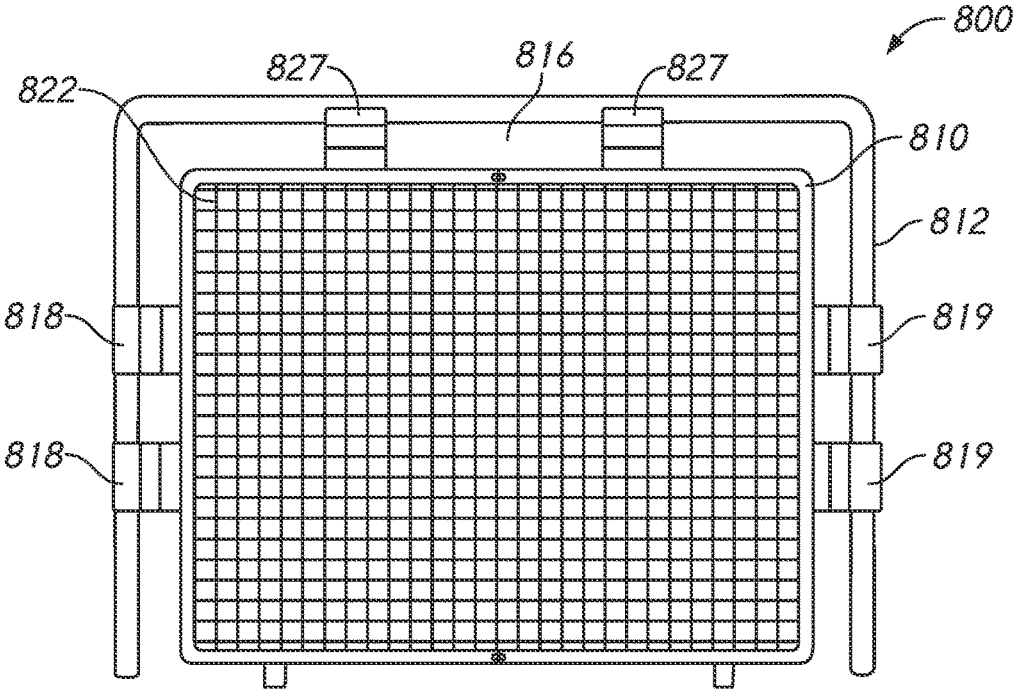
Figure 31:
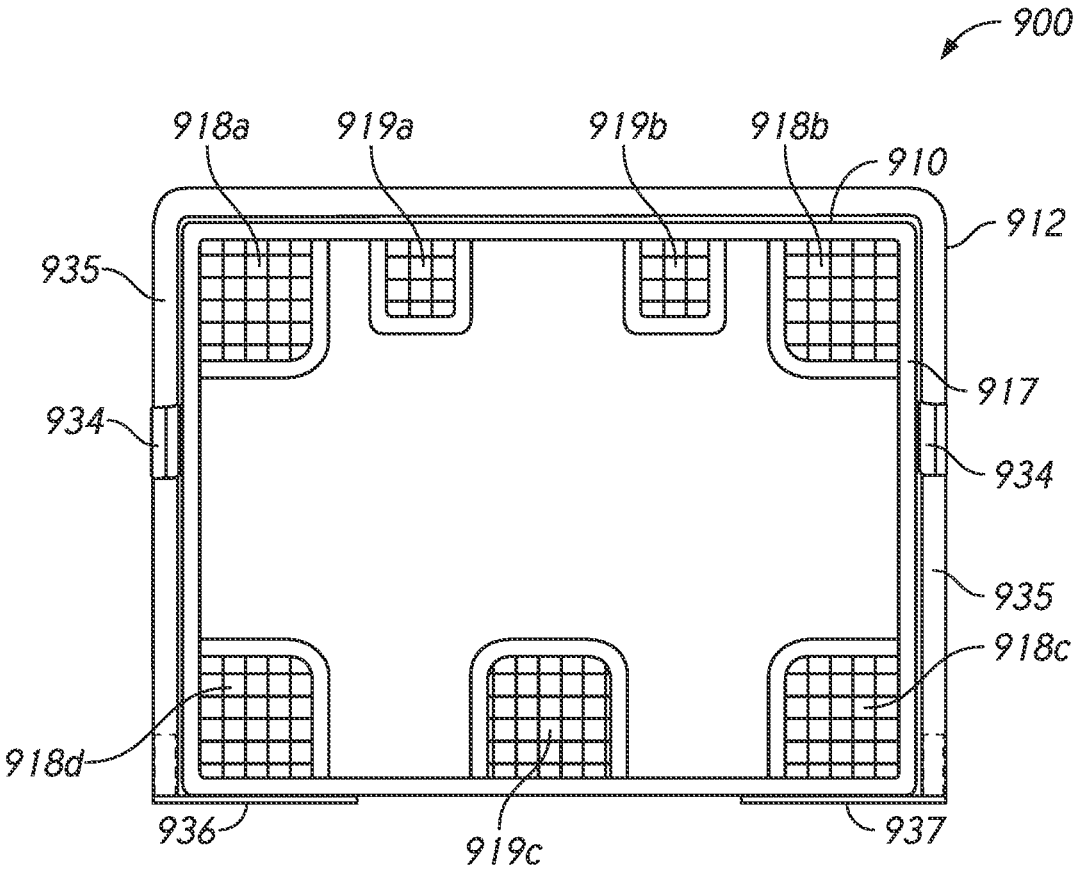

FIGS. 29 to 31 are front views of a goal shooting systems in accordance with various embodiments of the technology. Referring to FIG. 29, a goal shooting system 700 can include a goal shooting target 710 ("shooting target 710") and a sports goal 712. The shooting target 710 and sports goal 712 define corner target areas or openings 716*a*, 716*b*, 716*c*, 716*d* and a center lower opening 716*e*. A plurality of side arms 718 couple one side of a panel 722 to the goal 712, and a plurality of side arms 719 couple another side of the panel 722 to the goal 712. The shooting target 710 also includes crossbar seats 727.

Referring to FIG. 30, a goal shooting system 800 can include a goal shooting target 810 ("shooting target 810") and a sports goal 812. The shooting target 810 and sports goal 812 define a target area or opening 816. A plurality of side arms 818 couple one side of a panel 822 to the goal 812, and a plurality of side arms 819 couple another side of the panel 822 to the goal 812. The shooting target 810 also in includes crossbar seats 827.

FIG. 31 shows a goal shooting system 900 that includes a goal shooting target 910 ("shooting target 910") and a sports goal 912. The shooting target 910 can include a rectangular frame 917, corner blocking sections 918*a*, 918*b*, 918*c*, 918*d*, and blocking sections 919*a*, 919*b*, 919*c*. Instead of shooting playing objects at the openings, a player can shoot the playing objects at the blocking sections. To practice corner shots, for example, a player can shoot a playing object at one of the blocking sections 918*a*, 918*b*, 918*c*, or 918*d*. The blocking section can deflect the object back to the player. It will be appreciated that other panels disclosed herein can be targeted to practice shooting as well. The number, positions, and configurations of the blocking sections can be selected based on the shots to be practiced. The frame 917 can have holes or other features that allow rearrangement of the blocking sections. In some embodiments, the shooting target 910 includes arms 934 for engage posts 935 and sports goal supports 936, 937 coupled to the panel 917.

Figure 32:
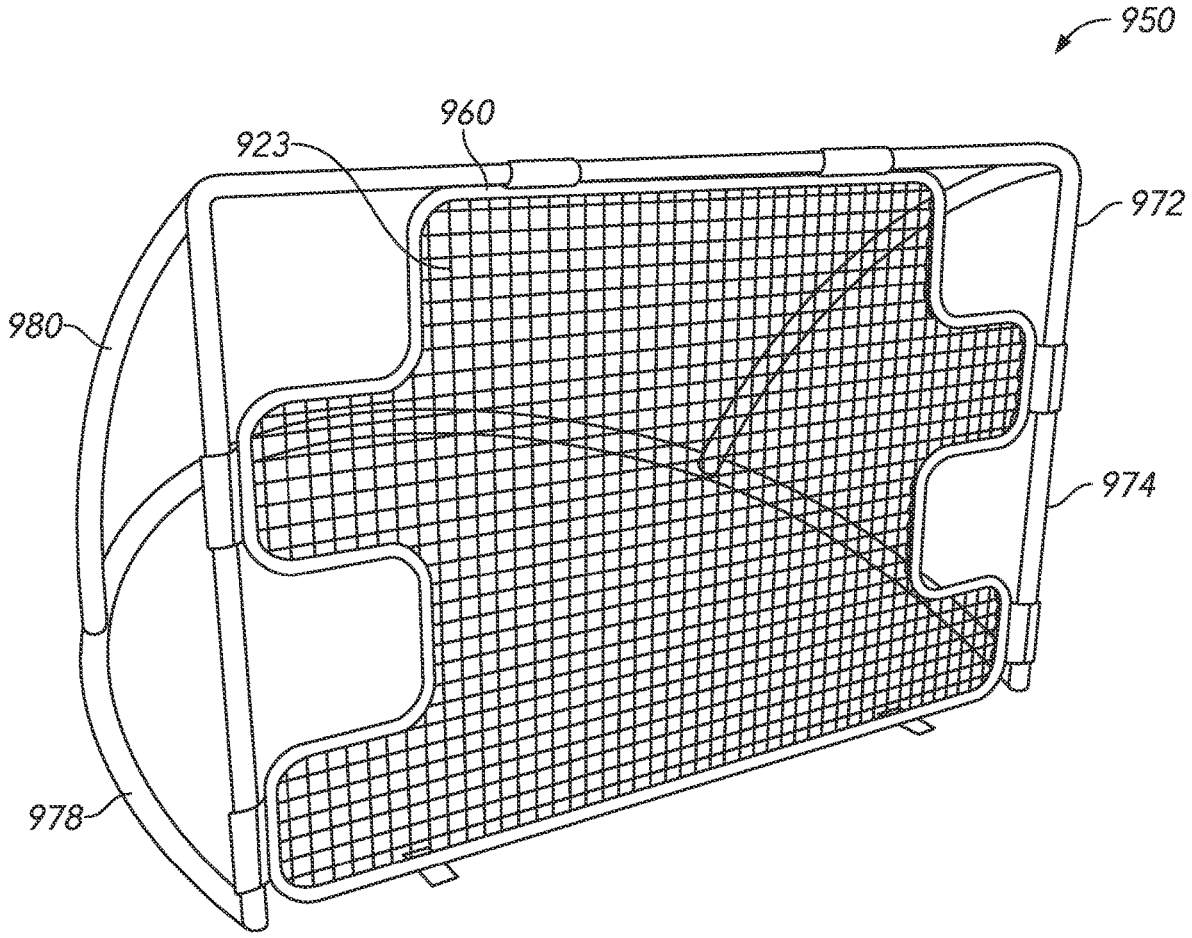
FIG. 32 is a perspective view of a goal shooting system in accordance with one embodiment of the technology.

FIG. 32 is a perspective view of a goal shooting system 950 in accordance with one embodiment of the technology. The goal shooting system 950 includes a goal shooting target 960 ("shooting target 960") and a sports goal 972. The relevant description of the panels disclosed herein applies equally to a panel 923 the shooting target 960. The sports goal 972 can include a frame 974, a base 978, and goal supports 980. The base 978 can rest on a support surface while the shooting target 960 supports most of the weight of the frame 974.

Figure 33:
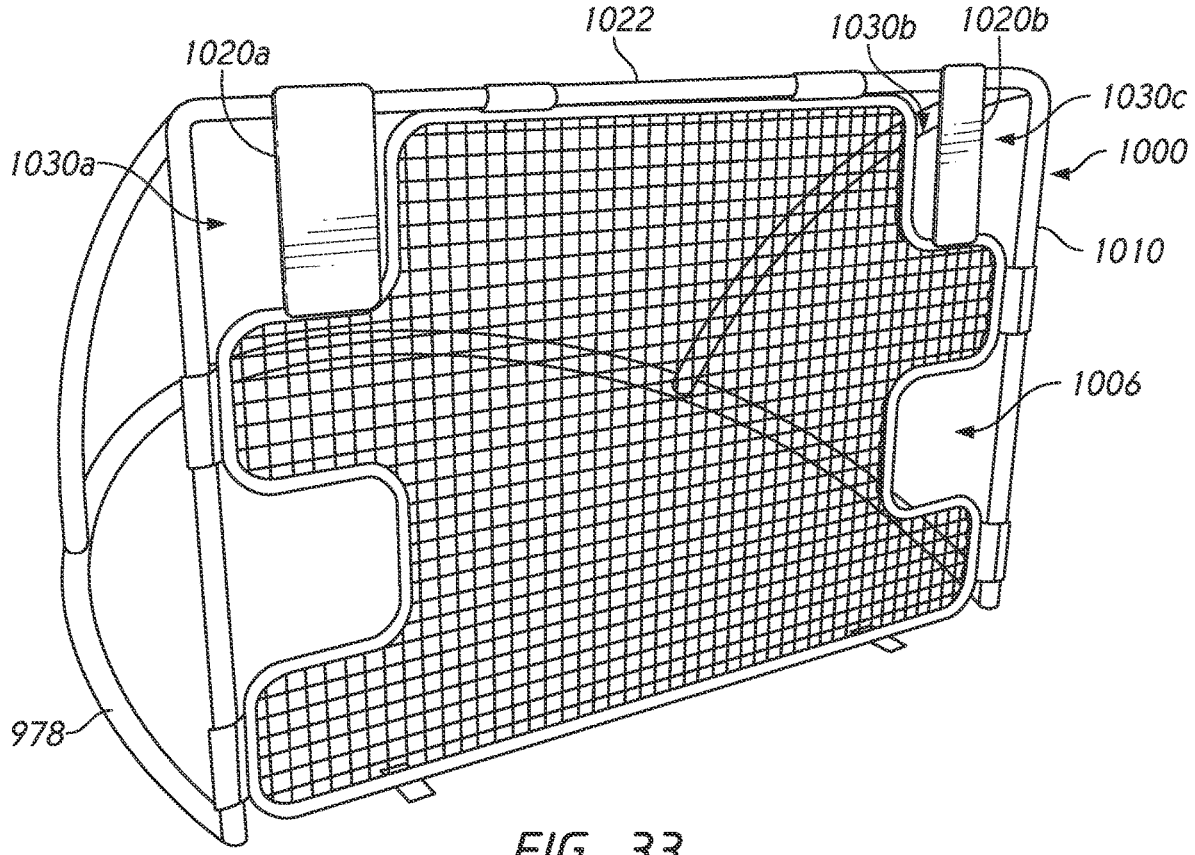
FIG. 33 is a perspective view of a goal shooting system in accordance with another embodiment of the technology.

FIG. 33 is a perspective view of a goal shooting system 1000 in accordance with another embodiment of the technology. The goal shooting system 1000 includes a goal shooting target 1006 ("shooting target 1006"), a sports goal 1010, and repositionable blockers 1020*a*, 1020*b* (collectively "blockers 1020"). The blockers 1020 can be detachably coupled to a frame 1022 of the sports goal 1010 and the goal shooting target 1006. The blockers 1020 can be used to adjust the target openings. For example, the blocker 1020*a* obstructs the upper left opening between the shooting target 1006 and the sports goal 1010 to define a target opening 1030*a*. The blocker 1020*b* extends across an upper right opening to define two target openings 1030*b*, 1030*c* on either side of the blocker 1020*b*.

The blockers 1020 can remain securely attached to the shooting target 1006 and the sports goal 1010 when they are struck by hockey pucks traveling at relatively high speeds (e.g., speeds equal to or great than 65 mph, 70 mph, 80 mph, 90 mph, 100 mph, 105 mph, etc.). The blockers 1020 can withstand (e.g., without being permanently damaged, without sustaining visible damage, etc.) the impact and can deflect the hockey pucks, for example, back toward the shooter. For example, the blockers 1020 can rebound an object traveling in a direction generally perpendicular or at an angle to the opening of the sport goal. The blockers 1020 can be reinstalled at various locations while the shooting target 1006 remains securely coupled to the sports goal 1010. This allows for quick and convenient adjustment of the target openings. During a practice session, the blockers 1020 can be repositioned any number of times to practice shooting to different target openings.

Figure 34:
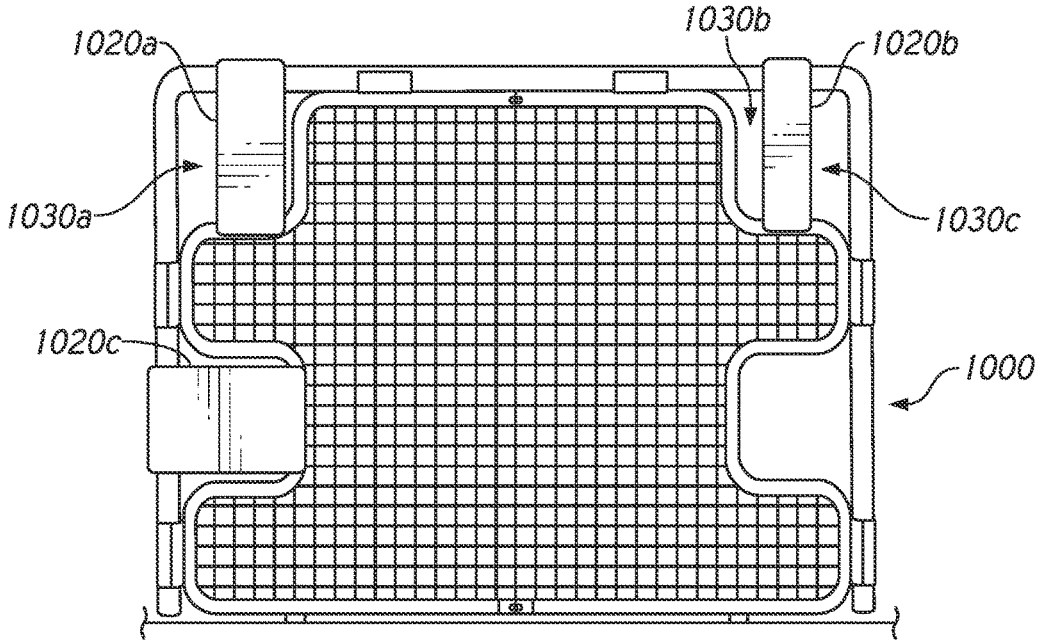
FIG. 34 is a front view of the goal shooting system of FIG. 33 with multiple shot blockers in accordance with one embodiment of the technology.

FIG. 34 is a front view of a goal shooting system 1000 with three blockers 1020*a*, 1020*b*, 1020*c*. The blocker 1020*a* partially blocks an upper left opening between the shooting target 1006 and the sports goal 1010 so as to define a target opening 1030*a*. The shooting opening 1030*b* can be smaller or bigger than either of the target openings 1030*a*, 1030*c*. The blocker 1020*c* completely blocks a lower left opening between the shooting target 1006 and the sports goal 1010. A hockey puck cannot pass through any gaps between the blocker 1020 the shooting target 1006 or the sports goal 1010.

The number and configuration of the blockers can be selected based on the desired training. For example, blockers can be dimensioned to block 10%, 20%, 30%, 40%, 50%, 60%, 70%, 80%, or 90% of an opening or gap (e.g., openings or gaps between the goal shooting target 1006 and the sports goal 1010). The blockers 1020 can be made, in whole or in part, of one or more rigid materials, flexible materials, or combinations thereof and can include one or more fasteners. In rigid embodiments, the blockers 1020 can be a member or plate made of plastic, metal, or other rigid material. The ends of the blockers 1020 can include fasteners (e.g., straps, clamps, etc.) for coupling to another structure, such as the shooting target 1006 or sports goal 1010. In flexible embodiments, the blockers 1020 can be made of a flexible material that can withstand tensioning. The tension blockers 1020 can extend across target openings and can be made, in whole or in part, of fabric, leather, or the flexible material. The ends of the blockers 1020 can include one or more snaps, hook and loop type fastener, or other coupling elements. In another embodiment, each blocker 1020 can include a metal frame and webbing (or netting) that extends across an interior opening of the metal frame. The webbing can deflect hockey pucks while mitigating noise caused by the impact. The configuration and composition of the blockers can be selected based on the deflection characteristics, noise requirements, configuration of the goal shooting target and/or goal, or combinations thereof. For example, a blocker configured for use with the goal shooting target 200 discussed in connection with FIGS. 8-11 can be the same as or different from a blocker configured for use with the goal shooting target 500 discussed in connection with FIG. 23. With respect the FIG. 23, the blocker, or blockers, can have ends configured to couple to adjacent blocking sections (e.g., blocking sections).

Although this invention has been disclosed in the context of certain embodiments and examples, it will be understood by those skilled in the art that the present invention extends beyond the specifically disclosed embodiments to other alternative embodiments and/or uses of the invention and obvious modifications and equivalents thereof. Although the sports goals can be hockey goals, they can also be lacrosse goals, soccer goals, or other suitable goals. Aspects of the embodiments can be modified, if necessary to employ concepts of the various patents, applications and publications to provide yet further embodiments. For example, U.S. Provisional Patent Application Nos. 62/484,286; 62/434,946; 62/434,946; and 62/525,694 and U.S. application Ser. No. 15/841,910 are incorporated herein by reference in its entirety and can be combined with embodiments disclosed herein. For example, a practice session can include usage of hockey puck rebounder and a goal shooting system. Various methods and techniques described above provide a number of ways to carry out the invention. Of course, it is to be understood that not necessarily all objectives or advantages described may be achieved in accordance with any particular embodiment described herein and may depend on the use of the mounting systems. Thus, for example, those skilled in the art will recognize that the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features (e.g., anchors, pads, fasteners, etc.) from different embodiments disclosed herein. For example, components of the tubular frame 140 in FIG. 4 can be coupled together using the connections discussed in connection with FIGS. 8-14. Additionally, the shooting goal target 110 of FIG. 1 can include other features disclosed herein, such as tie down members, including the tie down 211 discussed in connection with FIGS. 8-10. Accordingly, the various features and acts discussed above, as well as other known equivalents for each such feature or act, can be mixed and matched by one of ordinary skill in this art to perform methods in accordance with principles described herein.

Accordingly, features and components of various systems and devices disclosed herein can be mixed and matched to provide desired functionality. Additionally, it is contemplated that various aspects and features of the invention described can be practiced separately, combined together, or substituted for one another, and that a variety of combination and sub-combinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A goal shooting target, comprising:

a first goal support including a first base configured to rest on a support surface, and a first elongate member connected to the first base;

a second goal support including a second base configured to rest on the support surface, and a second elongate member connected to the second base; and a panel coupled to the first and second goal supports and positioned between the first and second elongate members, wherein the panel is configured to be positioned in an opening of a sports goal and to block an object that is shot at the panel when the first and second bases rest on the support surface, the first elongate member is positioned within a lower hollow end of an upright first goalpost of the sports goal, and the second elongate member is positioned within a lower hollow end of an upright second goalpost of the sports goal, wherein the first and second goal supports are configured to be captively held by the sports goal on the support surface such that a plurality of spaced apart target openings are located between the panel and the sports goal.

2. The goal shooting target of claim 1, further comprising a plurality of arms coupled to the panel and positioned to engage the sports goal when the object strikes the panel and the first elongate member is positioned within the lower hollow end of the upright first goalpost of the sports goal, and the second elongate member is positioned within the lower hollow end of the upright second goalpost of the sports goal.

3. The goal shooting target of claim 2, wherein the plurality of the arms includes a first post arcuate contact member configured to receive the upright first goalpost and a second arcuate contact member configured to receive the upright second goalpost.

4. The goal shooting target of claim 1, further comprising a plurality of arms coupled to the panel, the plurality of arms, first member, and second member cooperate to prevent the panel from dislodging from the sports goal when the panel deflects the object and the sports goal is coupled to the goal shooting target.

5. A goal shooting target, comprising:

a first member insertable into a first post of a sports goal, wherein the first member includes a first elongate body and a first dampener positionable between the first elongate body and the first post;

a second member insertable into a second post of the sports goal, wherein the second member includes a second elongate body and a second dampener positionable between the second elongate body and the second post; and a panel coupled to and positioned between the first and second members, the panel is configured to block an object that is shot at the panel when the first member is positioned within the first post and the second member is positioned within the second post.

6. The goal shooting target of claim 5, wherein at least one of the first dampener or the second dampener is a compressible tubular member.

* * * * *